US008190060B2

(12) United States Patent
Yoshinaga et al.

(10) Patent No.: US 8,190,060 B2
(45) Date of Patent: May 29, 2012

(54) FIXING DEVICE, IMAGE FORMING APPARATUS, AND METHOD OF MANUFACTURING TONER FOR IMAGE FORMING APPARATUS

(75) Inventors: Hiroshi Yoshinaga, Ichikawa (JP); Akira Shinshi, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 370 days.

(21) Appl. No.: 12/230,857

(22) Filed: Sep. 5, 2008

(65) Prior Publication Data

US 2009/0067902 A1 Mar. 12, 2009

(30) Foreign Application Priority Data

Sep. 12, 2007 (JP) ..... 2007-236800

(51) Int. Cl.
*G03G 15/20* (2006.01)

(52) U.S. Cl. ..... 399/122; 399/329

(58) Field of Classification Search ..... 399/122
See application file for complete search history.

(56) References Cited

U.S. PATENT DOCUMENTS 6,253,046 B1 * 6/2001 Horrall et al. ..... 399/124
6,628,916 B2 9/2003 Yasui et al.
6,636,709 B2 10/2003 Furukawa et al.
6,778,790 B2 8/2004 Yoshinaga et al.
6,778,804 B2 8/2004 Yoshinaga et al.
6,785,505 B2 8/2004 Yasui et al.
6,881,927 B2 4/2005 Yoshinaga et al.
6,882,820 B2 4/2005 Shinshi et al.
6,892,044 B2 5/2005 Yasui et al.
7,022,944 B2 4/2006 Yoshinaga et al.
7,127,204 B2 10/2006 Satoh et al.
7,151,907 B2 12/2006 Yoshinaga et al.
7,239,838 B2 7/2007 Sato et al.
7,242,897 B2 7/2007 Satoh et al.
7,313,353 B2 12/2007 Satoh et al.
7,330,682 B2 2/2008 Shinshi
(Continued)

FOREIGN PATENT DOCUMENTS

CN 1716127 1/2006
(Continued)

OTHER PUBLICATIONS

English language Abstract of JP 2005-202420 dated Jul. 28, 2005.
(Continued)

*Primary Examiner* — David Gray
*Assistant Examiner* — David Bolduc
(74) *Attorney, Agent, or Firm* — Harness, Dickey & Pierce, P.L.C.

(57) ABSTRACT

In a fixing device, a first fixing member and a second fixing member nip a recording medium so as to fix a toner image on the recording medium by applying heat and pressure to the recording medium. A pressure application lever presses the second fixing member toward the first fixing member. A pressure release lever supported by the pressure application lever supports a lock member. An elastic member pulls the lock member in a lock direction. The pressure release lever moves the lock member between a pressure application position, at which the lock member causes the pressure application lever to press the second fixing member toward the first fixing member so as to apply tension to the second fixing member, and a pressure release position, at which the second fixing member separates from the first fixing member so as to release tension applied to the second fixing member.

10 Claims, 8 Drawing Sheets

U.S. PATENT DOCUMENTS

| | | | | |
|---|---|---|---|---|
| 7,379,698 | B2 | 5/2008 | Yoshinaga et al. | |
| 7,869,753 | B2 | 1/2011 | Shinshi | |
| 7,899,350 | B2 | 3/2011 | Shinshi | |
| 7,912,392 | B2 | 3/2011 | Yoshinaga et al. | |
| 2002/0018663 | A1 | 2/2002 | Furukawa et al. | |
| 2002/0067936 | A1 | 6/2002 | Yasui et al. | |
| 2003/0000933 | A1 | 1/2003 | Yoshinaga et al. | |
| 2003/0007813 | A1 | 1/2003 | Yasui et al. | |
| 2003/0016963 | A1 | 1/2003 | Yoshinaga et al. | |
| 2003/0206758 | A1 | 11/2003 | Yasui et al. | |
| 2003/0215271 | A1 | 11/2003 | Yoshinaga et al. | |
| 2004/0013453 | A1 | 1/2004 | Shinshi et al. | |
| 2004/0190958 | A1* | 9/2004 | Matsumoto | 399/329 |
| 2005/0025539 | A1 | 2/2005 | Yoshinaga et al. | |
| 2005/0095043 | A1 | 5/2005 | Yoshinaga et al. | |
| 2005/0163543 | A1 | 7/2005 | Satoh et al. | |
| 2006/0002737 | A1* | 1/2006 | Shinshi | 399/122 |
| 2006/0116230 | A1 | 1/2006 | Satoh et al. | |
| 2006/0165429 | A1 | 7/2006 | Satoh et al. | |
| 2006/0165443 | A1 | 7/2006 | Yoshinaga et al. | |
| 2006/0177232 | A1 | 8/2006 | Ehara et al. | |
| 2006/0257183 | A1 | 11/2006 | Ehara et al. | |
| 2007/0003334 | A1 | 1/2007 | Shinshi et al. | |
| 2007/0014603 | A1 | 1/2007 | Satoh et al. | |
| 2007/0059003 | A1 | 3/2007 | Shinshi et al. | |
| 2007/0059071 | A1 | 3/2007 | Shinshi et al. | |
| 2007/0110464 | A1 | 5/2007 | Nakayama et al. | |
| 2007/0166085 | A1 | 7/2007 | Shinshi | |
| 2007/0292175 | A1 | 12/2007 | Shinshi | |
| 2008/0063443 | A1 | 3/2008 | Yoshinaga et al. | |
| 2008/0112739 | A1 | 5/2008 | Shinshi | |
| 2008/0175633 | A1 | 7/2008 | Shinshi | |
| 2008/0219730 | A1 | 9/2008 | Shinshi | |
| 2008/0253788 | A1 | 10/2008 | Shinshi | |
| 2008/0253789 | A1 | 10/2008 | Yoshinaga et al. | |
| 2008/0298862 | A1 | 12/2008 | Shinshi | |
| 2008/0317532 | A1 | 12/2008 | Ehara et al. | |

FOREIGN PATENT DOCUMENTS

| | | |
|---|---|---|
| JP | 05-173446 | 7/1993 |
| JP | 2000-214718 | 8/2000 |
| JP | 2000-221828 | 8/2000 |
| JP | 2001-013805 | 1/2001 |
| JP | 2001-066933 | 3/2001 |
| JP | 2001-201976 | 7/2001 |
| JP | 2001-242732 | 9/2001 |
| JP | 2001-318555 | 11/2001 |
| JP | 2002-174988 | 6/2002 |
| JP | 2004-287131 | 10/2004 |
| JP | 2006-048005 | 2/2006 |
| JP | 3947194 | 4/2007 |

OTHER PUBLICATIONS

Office Action dated Mar. 9, 2010 for corresponding Chinese Patent Application No. 200810213127.6.

* cited by examiner

FIXING DEVICE, IMAGE FORMING APPARATUS, AND METHOD OF MANUFACTURING TONER FOR IMAGE FORMING APPARATUS

PRIORITY STATEMENT

The present patent application claims priority from Japanese Patent Application No. 2007-236800, filed on Sep. 12, 2007, in the Japan Patent Office, the entire contents of which are hereby incorporated herein by reference.

BACKGROUND OF THE INVENTION

1. Field of the Invention

Example embodiments generally relate to a fixing device and an image forming apparatus, for example, for effectively applying pressure to a recording medium and releasing the pressure, and a method of manufacturing toner for the image forming apparatus.

2. Description of the Related Art

A related-art image forming apparatus, such as a copier, a printer, a facsimile machine, or a multifunction printer having at least one of copying, printing, scanning, and facsimile functions, typically forms a toner image on a recording medium (e.g., a sheet) based on image data using electrophotography. Thus, for example, a charger charges a surface of an image carrier. An optical writer emits a light beam onto the charged surface of the image carrier to form an electrostatic latent image on the image carrier according to the image data. A development device develops the electrostatic latent image with a developer (e.g., toner) to form a toner image on the image carrier. The toner image is then transferred from the image carrier onto a sheet. Finally, a fixing device applies heat and pressure to the sheet bearing the toner image to fix the toner image on the sheet, thus forming the toner image on the sheet.

In one example of the fixing device, a fixing roller, inside which a heater is provided, pressingly contacts a pressing roller. A pressing lever presses the pressing roller toward the fixing roller to form a fixing nip between the pressing roller and the fixing roller. While a sheet bearing a toner image passes through the fixing nip, the fixing roller and the pressing roller apply heat and pressure to the sheet to fix the toner image on the sheet.

When the sheet is jammed, the fixing device may stop operation in a state in which the fixing roller and the pressing roller nip the sheet. Accordingly, a user may not remove the sheet easily due to pressure applied to the sheet at the fixing nip. To address this problem, a pressure release lever may be provided in the fixing device. The user manually operates the pressure release lever to release the pressure applied to the sheet.

Currently, there is market demand for a compact-size image forming apparatus capable of forming an image at high speed. To accommodate such demand, the fixing roller and the pressing roller have a small diameter and rotate at high speed, and need to apply a greater pressure to each other in order to provide a longer nip that is, a larger surface area of contact, capable of supplying the heat needed for adequately fixing the toner image on the sheet. Consequently, when the pressure release lever needs to be released, the user needs to apply a stronger force to do so.

To address this problem, another example of the fixing device includes an automatic pressure release device for automatically releasing pressure applied to the fixing nip using a cam. However, a driver, such as a motor, for activating the automatic pressure release device is needed, resulting in an increase in weight and manufacturing costs of the fixing device.

In yet another example of the fixing device, the pressure release lever moves with opening and closing of a cover on the fixing device, for example by being slidably contacted and moved by the cover. However, when the fixing roller and the pressing roller apply a strong pressure to each other, the pressure release lever may slide on the cover with a strong frictional force generated between the pressure release lever and the cover, resulting in wear of the pressure release lever and the cover.

SUMMARY

At least one embodiment may provide a fixing device that includes a first fixing member, a second fixing member, a plurality of rollers, a pressure application lever, a pressure release lever, a lock member, and an elastic member. The first fixing member has a roller shape. The second fixing member has an endless belt shape and is disposed opposite the first fixing member. The first fixing member and the second fixings member form a pair of fixing members to nip a recording medium so as to fix a toner image on the recording medium by applying heat and pressure to the recording medium. The second fixing member is stretched around the plurality of rollers. The pressure application lever presses the second fixing member toward the first fixing member, and includes an immovable end fixed to the fixing device and a movable end provided opposite the immovable end. The pressure release lever is rotatably supported by the pressure application lever. The lock member includes a first end rotatably supported by the pressure release lever and a second end provided opposite the first end. The elastic member engages with the second end of the lock member to pull the lock member in a lock direction. The pressure release lever rotates to move the lock member between a pressure application position, at which the lock member causes the pressure application lever to press the second fixing member toward the first fixing member so as to apply tension to the second fixing member, and a pressure release position, at which the second fixing member separates from the first fixing member so as to release tension applied to the second fixing member. The elastic member pulls the pressure application lever and the lock member in the lock direction when the lock member is positioned at the pressure application position.

At least one embodiment may provide an image forming apparatus that includes an image forming device and a fixing device. The image forming device forms a toner image using a developer including toner on a recording medium according to image data. The fixing device fixes the toner image on the recording medium and includes a first fixing member, a second fixing member, a plurality of rollers, a pressure application lever, a pressure release lever, a lock member, and an elastic member. The first fixing member has a roller shape. The second fixing member has an endless belt shape and is disposed opposite the first fixing member. The first fixing member and the second fixing member form a pair of fixing members to nip the recording medium so as to fix the toner image on the recording medium by applying heat and pressure to the recording medium. The second fixing member is stretched around the plurality of rollers. The pressure application lever presses the second fixing member toward the first fixing member. The pressure application lever includes an immovable end fixed to the fixing device and a movable end provided opposite the immovable end. The pressure release lever is rotatably supported by the pressure application lever.

The lock member includes a first end rotatably supported by the pressure release lever and a second end provided opposite the first end. The elastic member engages with the second end of the lock member to pull the lock member in a lock direction. The pressure release lever rotates to move the lock member between a pressure application position, at which the lock member causes the pressure application lever to press the second fixing member toward the first fixing member so as to apply tension to the second fixing member, and a pressure release position, at which the second fixing member separates from the first fixing member so as to release tension applied to the second fixing member. The elastic member pulls the pressure application lever and the lock member in the lock direction when the lock member is positioned at the pressure application position.

At least one embodiment may provide a method of manufacturing toner for an image forming apparatus. The method includes performing at least one of dissolution and dispersion of a prepolymer including a modified polyester resin, a compound to perform at least one of an elongation reaction and a cross-linking reaction with the prepolymer, and a toner constituent including a pigment colorant, in an organic solvent to obtain an oily dispersion liquid. The method further includes performing at least one of an elongation reaction and a cross-linking reaction of any one of the dissolved liquid and the dispersed liquid in an aqueous medium to obtain a dispersion liquid. The method further includes removing a solvent from the dispersion liquid.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
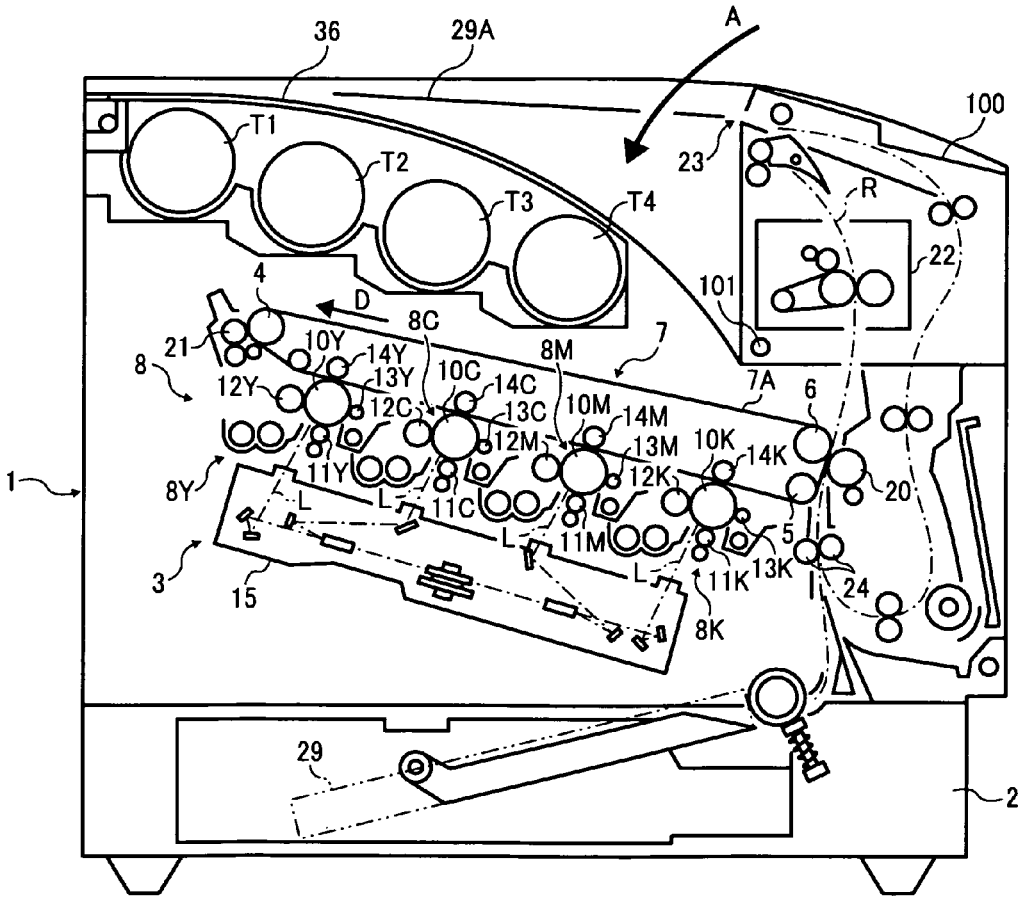
FIG. 1 is a sectional view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a sectional view of the image forming apparatus 1. The image forming apparatus 1 includes a paper tray 2, an image forming portion 3, a conveyance path R, a second transfer roller 20, a belt cleaner 21, toner bottles T1, T2, T3, and T4, a registration roller pair 24, an output device 23, an output tray 36, a cover 100, and/or a support 101.

The image forming portion 3 includes an image forming device 8, an intermediate transfer unit 7, an optical writing unit 15, and/or a fixing device 22.

The image forming device 8 includes image forming units 8Y, 8C, 8M, and/or 8K. The image forming units 8Y, 8C, 8M, and 8K include photoconductors 10Y, 10C, 10M, and 10K, chargers 11Y, 11C, 11M, and 11K, development devices 12Y, 12C, 12M, and 12K, and/or cleaners 13Y, 13C, 13M, and 13K, respectively. The intermediate transfer unit 7 includes rollers 4, 5, and 6, an intermediate transfer belt 7A, and/or first transfer rollers 14Y, 14C, 14M, and 14K.

The image forming apparatus 1 can be a copier, a facsimile machine, a printer, a plotter, a multifunction printer having at least one of copying, printing, scanning, plotter, and facsimile functions, or the like. According to this example embodiment, the image forming apparatus 1 functions as a tandem-type color printer for forming a full-color image on a recording medium by electrophotography.

The paper tray 2 is provided in a lower portion (e.g., a base) of the image forming apparatus 1, and loads a sheet 29 serving as a recording medium. The image forming portion 3 is provided above the paper tray 2. The four image forming units 8Y, 8C, 8M, and 8K include the photoconductors (e.g., photoconductive drums) 10Y, 10C, 10M, and 10K serving as image carriers, respectively. The intermediate transfer belt 7A, serving as an intermediate transfer member, is looped over the rollers 4, 5, and 6. The intermediate transfer belt 7A is a flexible endless belt The image forming units 8Y, 8C, 8M, and 8K and the intermediate transfer unit 7 are attachable to and detachable from the image forming apparatus 1.

The optical writing unit 15, serving as an optical writer, optically writes electrostatic latent images on the photoconductors 10Y, 10C, 10M, and 10K, respectively. The image forming units 8Y, 8C, 8M, and 8K develop the electrostatic latent images with yellow, cyan, magenta, and black toners to form yellow, cyan, magenta, and black toner images, respectively. The yellow, cyan, magenta, and black toner images are transferred from the photoconductors 10Y, 10C, 10M, and 10K onto the intermediate transfer belt 7A, and further transferred onto a sheet 29 sent from the paper tray 2 to form a color toner image on the sheet 29. The fixing device 22 fixes the color toner image on the sheet 29.

The conveyance path R is provided between the paper tray 2 and the fixing device 22 to convey the sheet 29 from the paper tray 2 to the fixing device 22. The roller 6 faces the conveyance path R. The intermediate transfer unit 7, the image forming device 8, the optical writing unit 15, and the fixing device 22 are provided in a substantially center portion of the image forming apparatus 1.

A portion of the intermediate transfer belt 7A between the rollers 4 and 5 corresponds to a lower side of a loop formed by the intermediate transfer belt 7A. The second transfer roller 20, serving as a second transfer member, faces the conveyance path R to oppose the roller 6 via the intermediate transfer belt 7A. The belt cleaner 21 opposes the roller 4 via the intermediate transfer belt 7A, and cleans a surface of the intermediate transfer belt 7A.

The image forming device 8 is provided below the intermediate transfer belt 7A to oppose the lower side of the loop formed by the intermediate transfer belt 7A. In the image forming units 8Y, 8C, 8M, and 8K, the photoconductors 10Y, 10C, 10M, and 10K contact the intermediate transfer belt 7A. The chargers 11Y, 11C, 11M, and 11K, the development devices 12Y, 12C, 12M, and 12K, and the cleaners 13Y, 13C, 13M, and 13K surround the photoconductors 10Y, 10C, 10M, and 10K, respectively. The first transfer rollers 14Y, 14C, 14M, and 14K, serving as first transfer members, are provided inside the loop formed by the intermediate transfer belt 7A to oppose the photoconductors 10Y, 10C, 10M, and 10K via the intermediate transfer belt 7A, respectively.

The image-forming units 8Y, 8C, 8M, and 8K have a common structure, but contain toners, serving as a developer, in colors different from each other. For example, the development devices 12Y, 12C, 12M, and 12K contain yellow, cyan, magenta, and black toners, respectively. The toner bottles T1, T2, T3, and T4 are provided in an upper portion of the image forming apparatus 1, and contain yellow, cyan, magenta, and black toners, respectively. When the yellow, cyan, magenta, and black toners contained in the development devices 12Y, 12C, 12M, and 12K, respectively, are consumed, the toner bottles T1, T2, T3, and T4 supply the yellow, cyan, magenta, and black toners to the development devices 12Y, 12C, 12M, and 12K, respectively.

The optical writing unit 15 is provided below the image forming device 8, and emits optically modulated laser beams L onto surfaces of the photoconductors 10Y, 10C, 10M, and 10K to form electrostatic latent images corresponding to yellow, cyan, magenta, and black colors on the surfaces of the photoconductors 10Y, 10C, 10M, and 10K, respectively.

The toner bottles T1, T2, T3, and T4, the intermediate transfer unit 7, the image forming device 8, and the optical writing unit 15 are slanted in a common direction in the image forming apparatus 1 to occupy an area smaller than an area occupied when the toner bottles T1, T2, T3, and T4, the intermediate transfer unit 7, the image forming device 8, and the optical writing unit 15 are provided parallel to a horizontal direction.

The registration roller pair 24 is provided upstream from the second transfer roller 20 in a sheet conveyance direction. The output device 23 is provided at an end of the conveyance path R in the upper portion of the image forming apparatus 1. The output tray 36 is provided in the upper portion of the image forming apparatus 1.

The following describes an image forming operation of the image forming apparatus 1 for forming a full-color image on a sheet 29.

When an image forming operation starts, a driver (not shown) rotates the photoconductors 10Y, 10C, 10M, and 10K clockwise in FIG. 1. The chargers 11Y, 11C, 11M, and 11K uniformly charge the surfaces of the photoconductors 10Y, 10C, 10M, and 10K to have a reference polarity. The optical writing unit 15 emits laser beams L onto the charged surfaces of the photoconductors 10Y, 10C, 10M, and 10K according to yellow, cyan, magenta, and black image data so as to form electrostatic latent images on the surfaces of the photoconductors 10Y, 10C, 10M, and 10K, respectively.

For example, desired fill-color image data is separated into the yellow, cyan, magenta, and black image data, so that the optical writing unit 15 forms the electrostatic latent images corresponding to the yellow, cyan, magenta, and black image data on the photoconductors 10Y, 10C, 10M, and 10K, respectively. When the electrostatic latent images pass between the photoconductors 10Y, 10C, 10M, and 10K and the development devices 12Y, 12C, 12M, and 12K, respectively, the development devices 12Y, 12C, 12M, and 12K supply yellow, cyan, magenta, and black toners to the electrostatic latent images to make the electrostatic latent images visible as yellow, cyan, magenta, and black toner images, respectively.

A driver (not shown) rotates one of the rollers 4, 5, and 6, over which the intermediate transfer belt 7A is looped, counterclockwise in FIG. 1 to rotate the intermediate transfer belt 7A counterclockwise in a rotating direction D. The one of the rollers 4, 5, and 6 rotated by the driver rotates the other rollers. The first transfer roller 14Y transfers the yellow toner image formed on the photoconductor 10Y onto the rotating intermediate transfer belt 7A.

The first transfer roller 14C transfers and superimposes the cyan toner image formed on the photoconductor 10C onto the yellow toner image on the intermediate transfer belt 7A. The first transfer roller 14M transfers and superimposes the magenta toner image formed on the photoconductor 10M onto the cyan toner image superimposed on the yellow toner image on the intermediate transfer belt 7A. The first transfer roller 14K transfers and superimposes the black toner image formed on the photoconductor 10K onto the magenta toner image superimposed on the cyan and yellow toner images on the intermediate transfer belt 7A. Thus, a full-color toner image is formed on the intermediate transfer belt 7A.

After the yellow, cyan, magenta, and black toner images are transferred from the photoconductors 10Y, 10C, 10M, and 10K, respectively, onto the intermediate transfer belt 7A, the cleaners 13Y, 13C, 13M, and 13K remove residual toners remaining on the surfaces of the photoconductors 10Y, 10C, 10M, and 10K from the surfaces of the photoconductors 10Y, 10C, 10M, and 10K, respectively. A discharger (not shown) discharges the surfaces of the photoconductors 10Y, 10C, 10M, and 10K to initialize a surface potential of the photoconductors 10Y, 10C, 10M, and 10K for a next image forming operation.

The registration roller pair 24 feeds a sheet 29 sent from the paper tray 2 and conveyed on the conveyance path R at a proper time to an opposing portion in which the roller 6 opposes the second transfer roller 20 via the intermediate transfer belt 7A. A transfer voltage having a polarity opposite to a polarity of the full-color toner image formed on the intermediate transfer belt 7A is applied to the second transfer roller 20. Accordingly, the full-color toner image is transferred from the intermediate transfer belt 7A onto the sheet 29. After the full-color toner image is transferred from the intermediate transfer belt 7A, the belt cleaner 21 removes residual toner remaining on the intermediate transfer belt 7A from the intermediate transfer belt 7A.

The sheet 29 bearing the full-color toner image is sent to the fixing device 22. While the sheet 29 passes through the fixing device 22, the fixing device 22 applies heat and pressure to the sheet 29 to melt and fix the full-color toner image on the sheet 29, so as to produce a print 29A bearing the fixed full-color toner image. The print 29A is output onto the output tray 36 via the output device 23.

In the image forming apparatus 1 having the above-described structure, the four image forming units 8Y, 8C, 8M, and 8K oppose the intermediate transfer belt 7A and the yellow, cyan, magenta, and black toner images are successively transferred and superimposed on the intermediate transfer belt 7A. Therefore, the image forming apparatus 1 may form a full-color toner image for a shorter period of time than an image forming apparatus including a single image forming unit and four development devices. Further, the output tray 36 provided in the upper portion of the image forming apparatus 1 does not protrude from the image forming apparatus 1, saving space.

The above describes the image forming operation for forming the full-color toner image on the sheet 29. Alternatively, one of the image forming units 8Y, 8C, 8M, and 8K may be used to form a monochrome toner image. Yet alternatively, two or three of the image forming units 8Y, 8C, 8M, and 8K may be used to form a bicolor or tricolor toner image. For example, in order to form a monochrome toner image, the image forming unit 8K may be used. Specifically, an electrostatic latent image is formed on the photoconductor 10K, and the development device 12K develops the electrostatic latent image into a black toner image. The black toner image is transferred onto a sheet 29 via the intermediate transfer belt 7A, and the fixing device 22 fixes the black toner image on the sheet 29.

The cover 100 is provided near the fixing device 22 and rotates about the support 101 so that the cover 100 is opened and closed with respect to the image forming apparatus 1. FIG. 1 illustrates the cover 100, which is closed. When the cover 100 rotates in an open direction A, a peripheral element surrounding the fixing device 22 is exposed. When the cover 100 is moved (e.g., opened or closed), a part of the fixing device 22 moves in accordance with the movement of the cover 100.

Figure 2A:
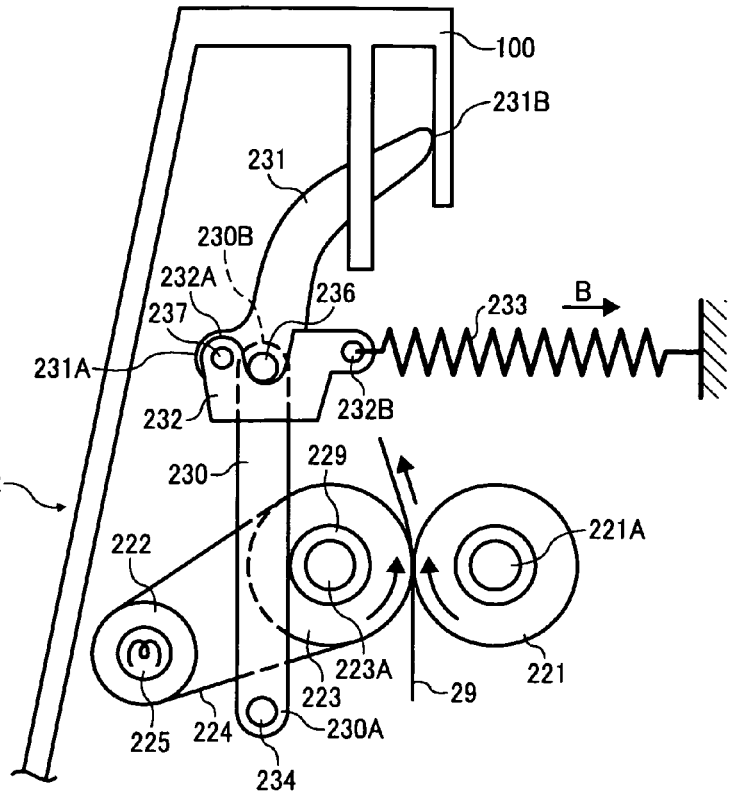
FIG. 2A is a sectional view (according to an example embodiment) of a fixing device and a cover included in the image forming apparatus shown in FIG. 1 when the cover is closed.
Figure 2B:
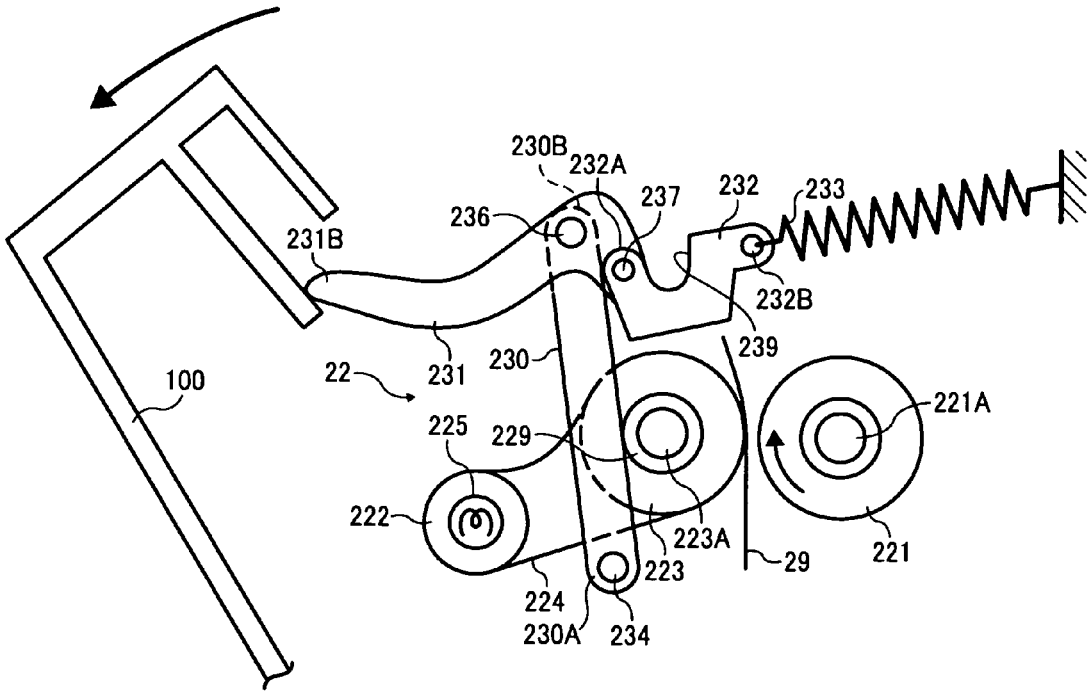
FIG. 2B is a sectional view (according to an example embodiment) of the fixing device and the cover shown in FIG. 2A when the cover is opened.

FIG. 2A is a sectional view of the fixing device 22 and the cover 100 when the cover 100 is closed. FIG. 2B is a sectional view of the fixing device 22 and the cover 100 when the cover 100 is opened.

As illustrated in FIG. 2A, the fixing device 22 includes a pressing roller 221, a heat source 221A, a heating roller 222, a roller 223, a fixing belt 224, a heat source 225, a bearing 229, a pressure application lever 230, a pressure release lever 231, a lock member 232, a coil spring 233, and/or shafts 234, 236, and 237. The roller 223 includes an end 223A. The pressure application lever 230 includes a lower end 230A and/or an upper end 230B. The pressure release lever 231 includes a base end 231A and/or a top end 231B. The lock member 232 includes ends 232A and/or 232B.

As illustrated in FIG. 2B, the fixing device 22 further includes a concave portion 239.

The pressing roller 221 and the fixing belt 224 oppose each other to form a pair of fixing members. The fixing belt 224 is stretched around the heating roller 222 and the roller 223. The heat source 225 is provided inside the heating roller 222 and is connected to a power source (not shown). The pressing roller 221 serves as a driving roller driven and rotated by a driving motor (not shown). The heat source 221A is provided inside the pressing roller 221. A side plate (not shown) rotatably supports the pressing roller 221 and the heating roller 222. The pressing roller 221 rotates clockwise in FIG 2A. The fixing belt 224 contacts the pressing roller 221, and is driven and rotated counterclockwise by the rotating pressing roller 221. Accordingly, the roller 223 and the heating roller 222 rotate counterclockwise.

The pressing roller 221 includes a core metal, an elastic layer, and a releasing layer. The core metal includes aluminum, iron, or the like. The elastic layer is formed on the core metal and includes a silicon rubber. The releasing layer serves as a surface layer and includes PFA (terra fluoro ethylene-perfluoro alkylvinyl ether copolymer), PTFE (poly tetra fluoro ethylene), or the like.

The end 223A is provided in a core metal of the roller 223. The bearing 229 rotatably supports the end 223A. A side plate (not shown) supports the bearing 229 in such a manner that the roller 223 may move closer to the pressing roller 221 and move away from the pressing roller 221. Namely, the movement of the roller 223 causes a surface of the fixing belt 224 to pressingly contact the pressing roller 221 and to separate from the pressing roller 221.

According to this example embodiment, a halogen heater is used as the heat source 225 to heat the heating roller 222, serving as a heated member and a heat circulating member, and the fixing belt 224. Alternatively, an induction heating method may be used to heat the heating roller 222 and the fixing belt 224. Generally, a commercial power source may apply a voltage of 100 V to the heat source 225. Alternatively, the commercial power source may include an auxiliary power source to supply power to the heat source 225. An electric double layer condenser (e.g., an electrochemical capacitor) may be preferably used as the auxiliary power source. According to this example embodiment, the heating roller 222 is used as the heat circulating member. Alternatively, an endless belt may be used as the heat circulating member.

The pressure application lever 230 presses the roller 223 toward the pressing roller 221. The pressure application lever 230 rotatably supports the pressure release lever 231. The pressure release lever 231 rotatably supports the end 232A of the lock member 232. The coil spring 233 engages with the end 232B of the lock member 232 and serves as an elastic member for pulling the lock member 232 in a lock direction B. Rotation of the pressure release lever 231 switches a position of the lock member 232 between a pressure application position at which the pressure application lever 230 presses the roller 223 toward the pressing roller 221 and a pressure release position at which the roller 223 separates from the pressing roller 221.

A side plate (not shown) rotatably supports one end of the pressure application lever 230, that is, the lower end 230A, serving as an immovable end, of the pressure application lever 230 via the shaft 234. Another end of the pressure application lever 230, that is, the upper end 230B, serving as a movable end, of the pressure application lever 230 rotatably supports the base end 231A of the pressure release lever 231 via the shaft 236.

When the cover 100 is moved so that the cover 100 is closed as illustrated in FIG. 2A and opened as illustrated in FIG. 2B, the top end 231B of the pressure release lever 231 slidabaly engages with a rib provided on an inner surface of the cover 100. Thus, the pressure release lever 231 moves in accordance with opening and closing of the cover 100.

The base end 231A of the pressure release lever 231 rotatably supports the end 232A of the lock member 232 via the shaft 237. When the lock member 232 moves between a lock position as illustrated in FIG. 2A and a release position as illustrated in FIG. 2B, the shaft 237 moves between both sides (e.g., left and right sides) of the shaft 236 serving as a hinge of the pressure release lever 231, respectively. When the pressure release lever 231 is at a lock position as illustrated in FIG. 2A, the shaft 237 opposes the end 232B of the lock member 232 via the shaft 236. When the pressure release lever 231 is at a release position as illustrated in FIG. 2B, the shaft 237 is positioned in a side with respect to the shaft 236 in which the end 232B of the lock member 232 is positioned. When the pressure release lever 231 is at a pressure application position as illustrated in FIG. 2A, the shaft 236 enters a gap between the ends 232A and 232B of the lock member 232 to maintain the lock member 232 and the pressure application lever 230 at the lock position. When the pressure release lever 231 is at a pressure release position as illustrated in FIG. 2B, the shaft 236 moves out of the gap between the ends 232A and 232B of the lock member 232 to move the lock member 232 and the pressure application lever 230 from the lock position. Accordingly, the concave portion 239 is provided between the ends 232A and 232B of the lock member 232. When the pressure release lever 231 moves about the shaft 236 counterclockwise in FIGS. 2A and 2B, the pressure release lever 231 moves from an upper side of the lock member 232. Therefore, an opening of the concave portion 239 faces upward from the lock member 232. When the shaft 236 is in the concave portion 239, the concave portion 239 holds the shaft 236 at a position substantially directly above the shaft 234.

When the cover 100 moves from a close position as illustrated in FIG. 2A to an open position as illustrated in FIG. 2B, the cover 100 pushes the top end 231B of the pressure release lever 231 to cause the pressure release lever 231 to rotate about the shaft 236 counterclockwise. In accordance with the rotation of the pressure release lever 231, the end 232A of the lock member 232, which is rotatably supported by the pressure release lever 231 via the shaft 237, moves down and the lock member 232 rotates. Accordingly, the shaft 236 moves out of the concave portion 239. The coil spring 233 pulls the lock member 232 and the shaft 237 moves to a right side in FIG. 2B of the shaft 236. For example, the shaft 237 moves to a side in which the end 232B of the lock member 232 is provided. In other words, the shaft 237 moves closer to the coil spring 233 so that the coil spring 233 has a natural length. When the lock member 232 moves to a position at which the end 232A of the lock member 232 is closer to the end 232B than the shaft 236 is, weight of the cover 100 is applied to the pressure release lever 231 while the coil spring 233 applies a pulling force to the pressure release lever 231. Accordingly, the pressure application lever 230 rotates about the shaft 234 in a direction in which the cover 100 rotates. Consequently, pressure applied to the pressing roller 221 is released.

When the cover 100 moves from the open position as illustrated in FIG. 2B to the close position as illustrated in FIG. 2A, the cover 100 pushes the top end 231 B of the pressure release lever 231. Accordingly, the sure release lever 231 and the pressure application lever 230 move in a pressing direction (e.g., to the right in FIG. 2B) so as to press the roller 223 toward the pressing roller 221 via the fixing belt 224. When the fixing belt 224 contacts the pressing roller 221, the movement of the pressure application lever 230 is regulated. Thus, the pressure release lever 231 rotates about the shaft 236 clockwise. In accordance with the rotation of the pressure release lever 231, the lock member 232, which is rotatably supported by the pressure release lever 231 via the shaft 237, moves about the shaft 236 to the left in FIG. 2B against a spring force applied by the coil spring 233. When the pressure release lever 231 moves farther in a close direction in which the cover 100 is closed, the shaft 236 enters the concave portion 239 to regulate the movement of the pressure release lever 231. The coil spring 233 applies a spring force to the lock member 232 in the lock direction B. Accordingly, the pressure release lever 231 is held at the lock position so that the roller 223 presses the pressing roller 221 via the fixing belt 224.

As illustrated in FIG. 2A, the pressure application lever 230 engages with the lock member 232 at a position on the pressure application lever 230 farthest from the shaft 234 about which the pressure application lever 230 rotates. The coil spring 233 applies a spring force to the lock member 232 to pull the lock member 232 and the pressure application lever 230 in the lock direction B. The lock member 232 is provided at a position on the pressure application lever 230 farthest from the shaft 234. Therefore, due to the principle of leverage, the coil spring 233 may apply a spring force smaller than a spring force needed when the lock member 232 is provided at a position on the pressure application lever 230 closer to the shaft 234. Accordingly, the shaft 236 may receive a smaller force when the shaft 236 moves on the lock member 232.

As described above, according to this example embodiment, a pressure applied between the fixing belt 224 and the pressing roller 221 is released without using an external driving device such as a motor. Consequently, the compact, lightweight fixing device 22 may be manufactured at reduced costs. The pressure application lever 230 engages with the lock member 232 at the position on the pressure application lever 230 farthest from the shaft 234, and the coil spring 233 pulls the lock member 232 and the pressure supply lever 230. Thus, the shaft 236 may slide on the lock member 232 with a decreased frictional force, resulting in an improved durability of the shaft 236 and the lock member 232.

Figure 3:
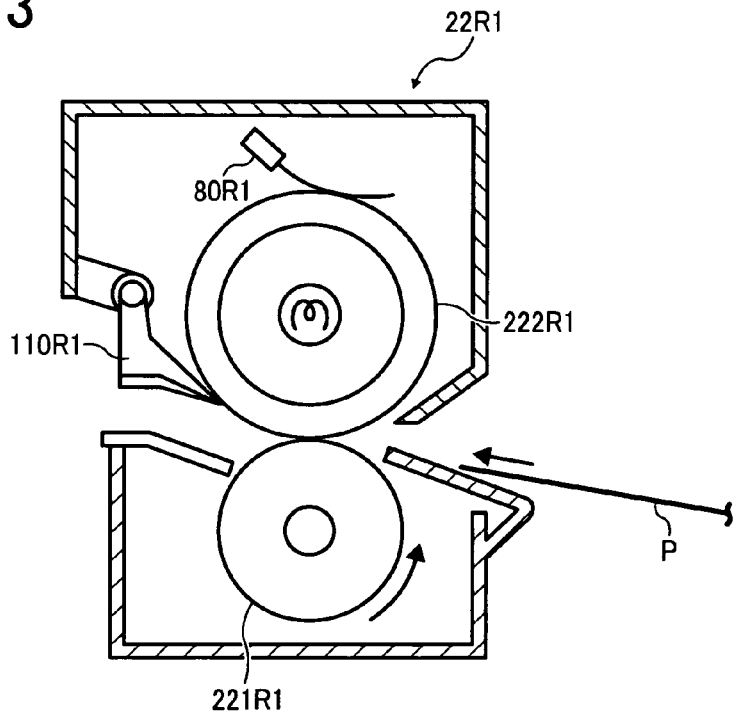
FIG. 3 is a sectional view of a reference fixing device using a roller method.

FIG. 3 is a sectional view of a reference fixing device 22R1 using a roller method. The fixing device 22R1 includes a heating roller 222R1, a pressing roller 221R1, a thermistor 80R1, and/or a separator 110R1.

The heating roller 222R1 and the pressing roller 221R1 form a pair of rollers opposing each other to form a nip. While a sheet P passes through the nip formed between the heating roller 222R1 and the pressing roller 221R1, the heating roller 222R1 and the pressing roller 221R1 apply heat and pressure to the sheet P to melt and fix a toner image on the sheet P. The thermistor 80R1 detects a temperature of the heating roller 222R1. The separator 100R1 separates the sheet P bearing the fixed toner image from the heating roller 222R1.

Figure 4:
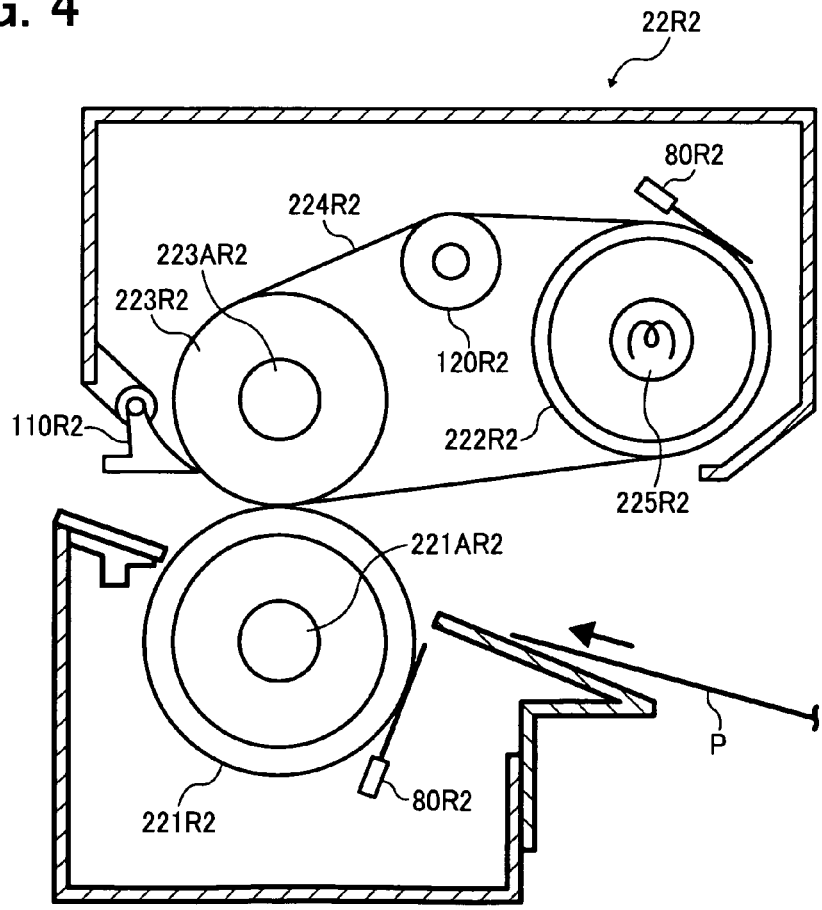
FIG. 4 is a sectional view of another reference fixing device using a belt method.

FIG. 4 is a sectional view of a reference fixing device 22R2 using a belt method. The fixing device 22R2 includes a pressing roller 221R2, a heating roller 222R2, a roller 223R2, a fixing 224R2, a heat source 225R2, a heat source 221AR2, a tension roller 120R2, a thermistor 80R2, and/or a separator 110R2. The roller 223R2 includes the end 223AR2.

The fixing belt 224R2 is stretched around the heating roller 222R2 and the roller 223R2. The roller 223R2 opposes the pressing roller 221R2 via the fixing belt 224R2. A side plate (not shown) rotatably supports the pressing roller 221R2, the heating roller 222R2, and the roller 223R2. The heating roller 222R2 and the roller 223R2 drive the fixing belt 224R2. The heat source 221AR2 is provided inside the pressing roller 221R2 and heats an outer circumferential sure of the fixing belt 224R2. The heat source 225R2 is provided inside the heating roller 222R2 and faces an inner circumferential surface of the fixing belt 224R2 to heat the fixing belt 224R2.

The roller 223R2 and the pressing roller 221R2 oppose each other via the fixing belt 224R2 to form a nip. While a sheet P passes through the nip formed between the roller 223R2 and the pressing roller 221R2, the roller 223R2 and the pressing roller 221R2 apply heat and pressure to the sheet P to melt and fix a toner image on the sheet P. The thermistors 80R2 detect a temperature of the heating roller 222R2 and the pressing roller 221R2, respectively. The separator 110R2 separates the sheet P bearing the fixed toner image from the fixing belt 224R2.

The fixing belt 224R2 has a volume and a thermal capacity smaller than a volume and a thermal capacity of the heating roller 222R1 depicted in FIG. 3. Therefore, the fixing belt 224R2 may be heated up to a fixing temperature more quickly than the heating roller 222R1. Namely, the fixing device 22R2 may be heated up to the fixing temperature more quickly than the fixing device 22R1 depicted in FIG. 3 when powered on. Further, the fixing device 22R2 includes two heat sources 225R2 and 221AR2 for heating the inner and outer circumferential surfaces of the fixing belt 224R2, respectively, so as to be heated up to the fixing temperature within a shorter period of time.

In order to effectively heat the fixing belt 224R2, the heating roller 222R2 needs to contact the fixing belt 224R2 for a period of time as long as possible. Further, in order to prevent deviation of the fixing belt 224R2, the fixing belt 224R2 needs to be stretched around the heating roller 222R2 and the roller 223R2 with a proper tension. To address this, the tension roller 120R2 applies a tension to the fixing belt 224R2. The tension roller 120R2 is provided inside a loop formed by the fixing belt 224R2. Alternatively, the tension roller 120R2 may be provided outside the loop formed by the fixing belt 224R2.

When the tension roller 120R2 is configured to generate heat, it takes costs. To address this, the tension roller 120R2 generally includes metal or a heat-resistant resin. However, the tension roller 120R2 may absorb heat from the fixing belt 224R2, preventing quick heating of the fixing belt 224R2. Moreover, when the fixing belt 224R2 is stretched around the heating roller 222R2 and the roller 223R2 without moving for a long period of time, a roller shape of the tension roller 120R2 may deform the fixing belt 224R2.

By contrast, in the fixing device 22 depicted in FIG. 2A, the tension roller 120R2 is not provided, but the pressure application lever 230 is provided to apply a tension to the fixing belt 224. For example, when the pressure application lever 230 moves to the pressure application position as illustrated in FIG. 2A, the pressure application lever 230 presses the roller 223 toward the pressing roller 221 so as to apply a tension to the fixing belt 224. When the pressure application lever 230 moves to the pressure release position as illustrated in FIG. 2B, the roller 223 separates from the pressing roller 221 so as to release the tension applied to the fixing belt 224. Thus, the tension roller 120R2 is not needed, resulting in reduced manufacturing costs. Further, the fixing device 22 may be heated up to a fixing temperature quickly because the tension roller 120R2, which may absorb heat, is not provided, shortening a first print time and saving energy.

When the pressure release lever 231 moves to the pressure release position as illustrated in FIG. 2B, the coil spring 233 is not stretched excessively. Therefore, a user may easily open and close the cover 100 with a decreased force. Further, the top end 231B of the pressure release lever 231 may slide on the inner surface of the cover 100 with a decreased frictional force, preventing wear of the pressure release lever 231 and the cover 100. When the cover 100 is opened and the roller 223 is not pressed against the pressing roller 221 as illustrated in FIG. 2B, the coil spring 233 recovers natural length. Namely, elements of the fixing device 22 may be assembled while the coil spring 233 does not apply a spring force, providing improved assembly operations.

Generally, the user opens the cover 100 when a sheet 29 is jammed. According to this example embodiment, when the user opens the cover 100, the fixing belt 224 and the pressing roller 221 do not nip the sheet 29. Thus, the user may easily remove the jammed sheet 29 from the fixing device 22.

Figure 5:
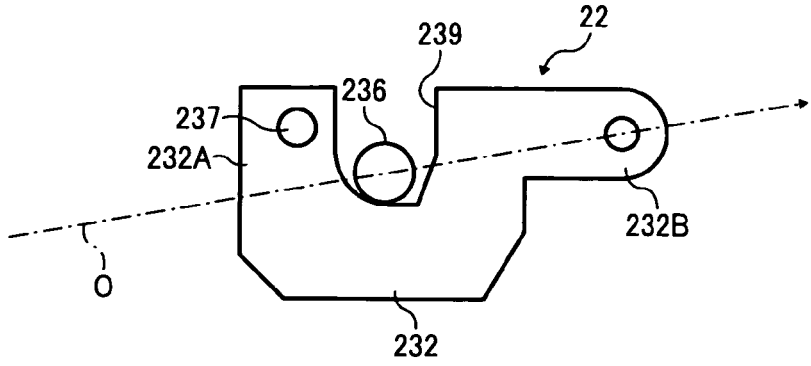
FIG. 5 is a partially enlarged sectional view (according to an example embodiment) of the fixing device shown in FIG. 2A.

When the pressure release lever 231 is at the pressure application position, the shaft 237, serving as a hinge of the lock member 232, may be positioned above a line O connecting the end 232B of the lock member 232, serving as a hook point at which the coil spring 233 is hooked, with the shaft 236 serving as a hinge of the pressure release lever 231, as illustrated in FIG. 5. In this case, when the coil spring 233 pulls the lock member 232, the lock member 232 tends to rotate clockwise. However, the shaft 236 regulates the lock member 232 to prevent the lock member 232 from rotating clockwise. When the pressure release lever 231 rotates to the pressure release position, the shaft 237 of the lock member 232 rotates counterclockwise in accordance with the rotation of the pressure release lever 231 until the shaft 237 is positioned below the line O. After the shaft 237 is positioned below the line O, a spring force applied by the coil spring 233 rotates the lock member 232 clockwise until the coil spring 233 recovers natural length. Thus, the length of the coil spring 233 may be maintained at a given position. Consequently, the pressure application lever 230 may apply a constant pressure to the roller 223.

Figure 6:
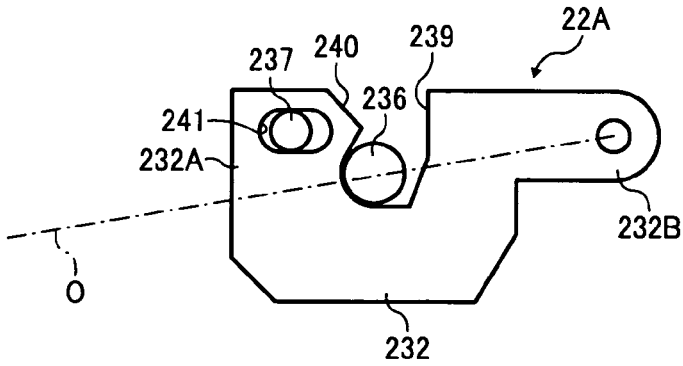
FIG. 6 is a sectional view of a fixing device according to another example embodiment.

FIG. 6 is a sectional view of a fixing device 22A according to another example embodiment. The fixing device 22A includes a protrusion 240 and/or a long hole 241. The other elements of the fixing device 22A are common to the fixing device 22 depicted in FIG. 5.

When the shaft 237 of the lock member 232 is positioned near the line O, the pressure release lever 231 (depicted in FIG. 2A) may stop before moving to a proper position to release a pressure applied to the roller 223 (depicted in FIG. 2A). Consequently, a proper pressure may not be applied to the roller 223. For example, an excessively weak or strong pressure may be applied to the roller 223. To address this problem, the fixing device 22A includes the protrusion 240 and the long hole 241.

The protrusion 240 is provided on the concave portion 239 provided in the lock member 232. The long hole 241 is provided in the end 232A of the lock member 232. The shaft 237 plays in and engages with the long hole 241 so that the protrusion 240 may surmount the shaft 236 of the pressure release lever 231. Accordingly, the pressure release lever 231 does not stop at an improper position. Consequently, the pressure application lever 230 (depicted in FIG. 2A) may apply a pressure to the roller 223 stably.

Figure 7:
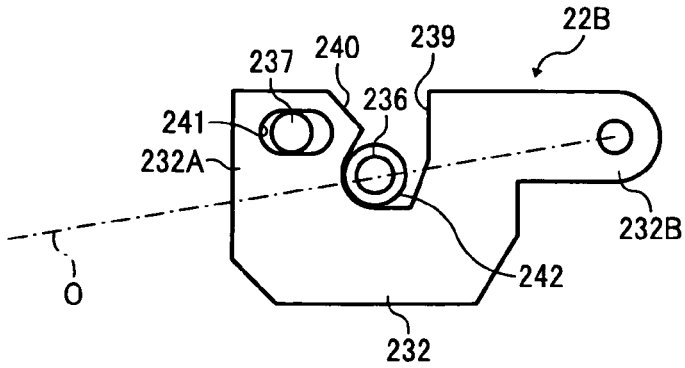
FIG. 7 is a sectional view of a fixing device according to yet another example embodiment.

FIG. 7 is a sectional view of a fixing device 22B according to yet another example embodiment. The fixing device 22B includes a bearing 242. The other elements of the fixing device 22B are common to the fixing device 22 depicted in FIG. 5.

When the protrusion 240 formed on the lock member 232 surmounts the shaft 236 of the pressure release lever 231 (depicted in FIG. 2A), the protrusion 240 slides on the shaft 236. Therefore, the shaft 236 may be worn and damaged over time. To address this problem, the bearing 242 surrounds the shaft 236 so that the shaft 236 does not contact the concave portion 239. Thus, the protrusion 240 surmounts an outer circumferential surface of the bearing 242. Namely, the protrusion 240 does not slide on the shaft 236. Consequently, the shaft 236 may not be worn, resulting in an improved durability of the shaft 236.

Figure 8:
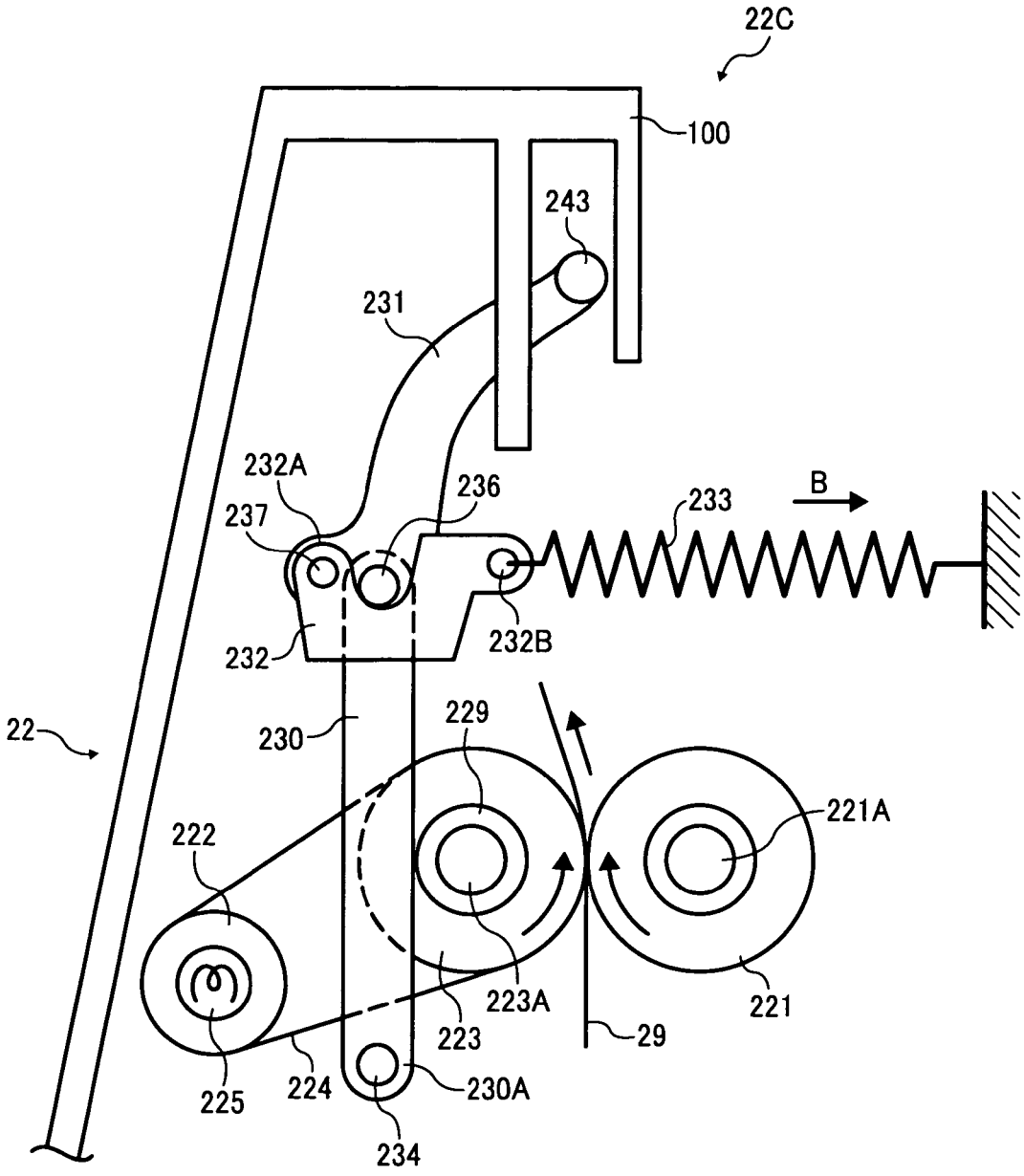
FIG. 8 is a sectional view of a fixing device according to yet another example embodiment.

FIG. 8 is a sectional view of a fixing device 22C according to yet another example embodiment. The fixing device 22C includes a roller 243. The other elements of the fixing device 22C are common to the fixing device 22 depicted in FIG. 2A.

In the fixing device 22 depicted in FIGS. 2A and 2B, the top end 231B of the pressure release lever 231 contacts the inner surface of the cover 100. When the rotatable roller 243 is provided on the top end 231B, as illustrated in FIG. 8, the roller 243 may contact the cover 100 with a decreased frictional force. Accordingly, the user may open and close the cover 100 with a decreased force, improving usability of the fixing device 22C.

Figure 9A:
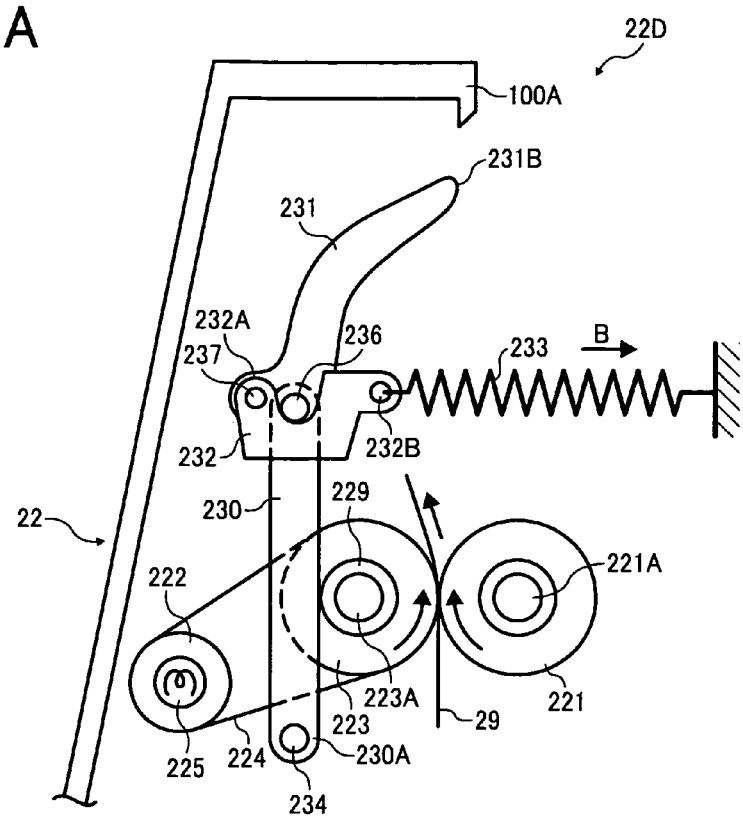
FIG. 9A is a sectional view of a fixing device according to yet another example embodiment when a pressure is applied.
Figure 9B:
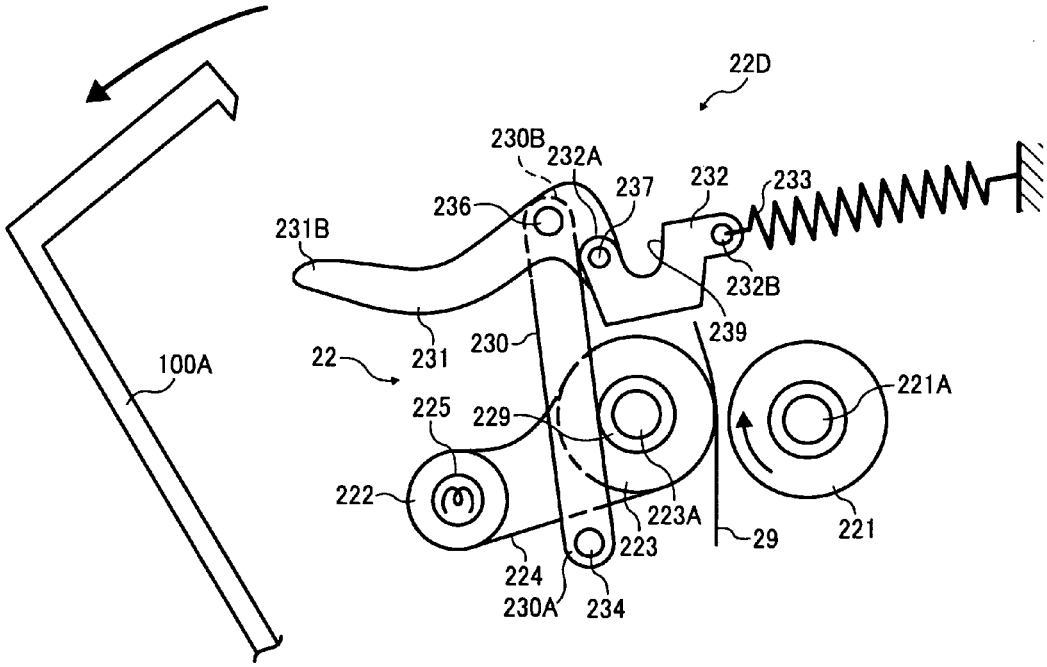
FIG. 9B is a sectional view (according to an example embodiment) of the fixing device shown in FIG. 9A when the pressure is released.

Referring to FIGS. 9A and 9B, the following describes a fixing device 22D according to yet another example embodiment. The fixing device 22D includes a cover 100A instead of the cover 100 depicted in FIG. 2A. The other elements of the fixing device 22D are common to the fixing device 22 depicted in FIG. 2A. FIG. 9A is a sectional view of the fixing device 22D when the cover 100A is closed and a pressure is applied. FIG. 9B is a sectional view of the fixing device 22D when the cover 100A is opened and the pressure is released.

In the fixing device 22 depicted in FIGS. 2A and 2B, the top end 231B of the pressure release lever 231 engages with the cover 100, and the pressure release lever 231 moves in accordance with the movement (e.g., opening and closing) of the cover 100. Alternatively, the pressure release lever 231 may move not in accordance with the movement of the cover 100A, as illustrated in FIGS. 9A and 9B. For example, when the cover 100A is opened as illustrated in FIG. 9B, the fixing device 22D is exposed. The user may directly operate (e.g., move) the pressure release lever 231 to press the fixing belt 224 toward the pressing roller 221 or separate the fixing belt 224 from the pressing roller 221.

Figure 10A:
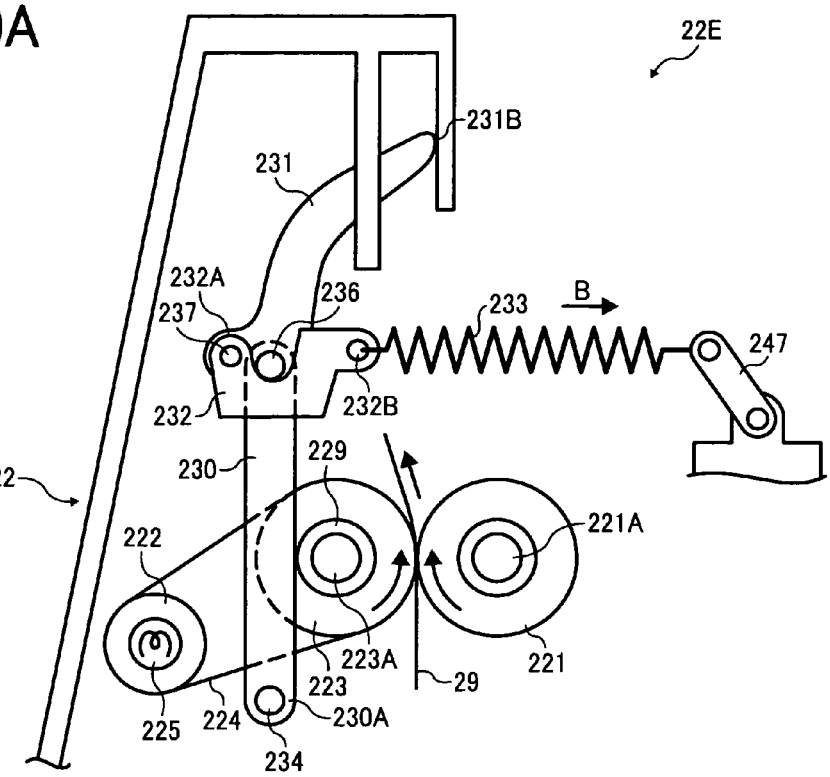
FIG. 10A is a sectional view of a fixing device according to yet another example embodiment when a small pressure is applied.
Figure 10B:
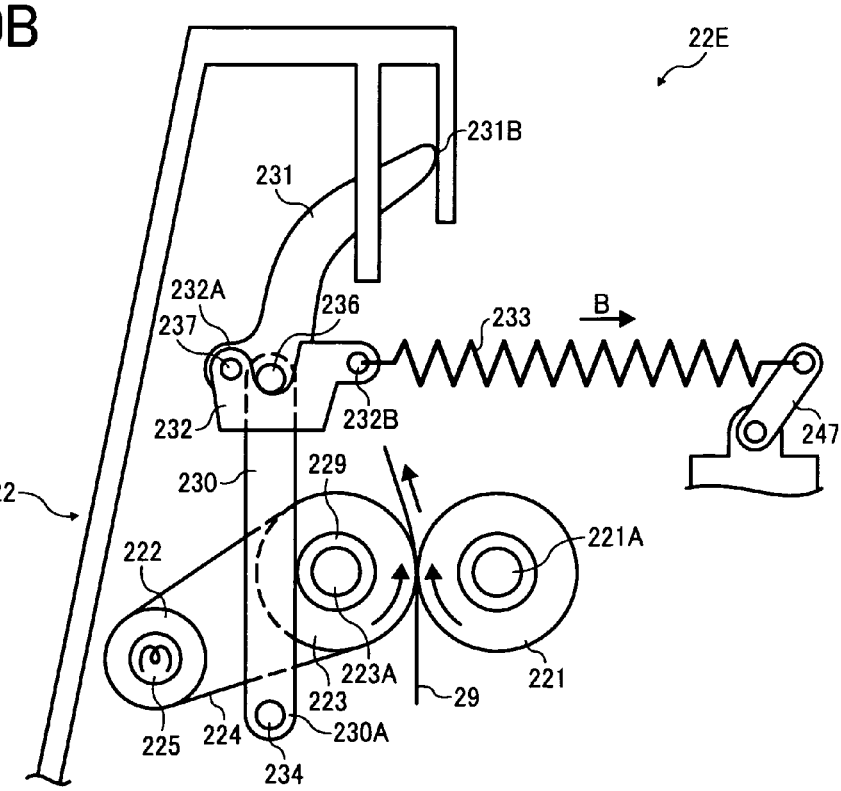
FIG. 10B is a sectional view (according to an example embodiment) of the fixing device shown in FIG. 10A when a great pressure is applied.

Referring to FIGS. 10A and 10B, the following describes a fixing device 22E according to yet another example embodiment. The fixing device 22E includes a support member 247. The other elements of the fixing device 22E are common to the fixing device 22 depicted in FIG. 2A.

The support member 247 supports the coil spring 233. When the support member 247 moves, the length of the coil spring 233 changes. Accordingly, a pressure with which the fixing belt 224 and the pressing roller 221 nip a sheet 29 changes.

When the support member 247 is inclined toward left as illustrated in FIG. 10A, the coil spring 233 has a length equivalent to the length of the coil spring 233 illustrated in FIG. 2A. Accordingly, the fixing belt 224 and the pressing roller 221 of the fixing device 22E nip the sheet 29 with a pressure equivalent to the pressure with which the fixing belt 224 and the pressing roller 221 of the fixing device 22 depicted in FIG. 2A nip the sheet 29. However, when the support member 247 is inclined toward right as illustrated in FIG. 10B, the coil spring 233 is elongated. Accordingly, the fixing belt 224 and the pressing roller 221 of the fixing device 22E may nip the sheet 29 with a greater pressure, resulting in an improved fixing property for fixing a toner image on the sheet 29 and an improved gloss of the toner image. The improved fixing property and gloss may be provided especially when the toner image is formed on the sheet 29 by using toner described below.

Figure 11:
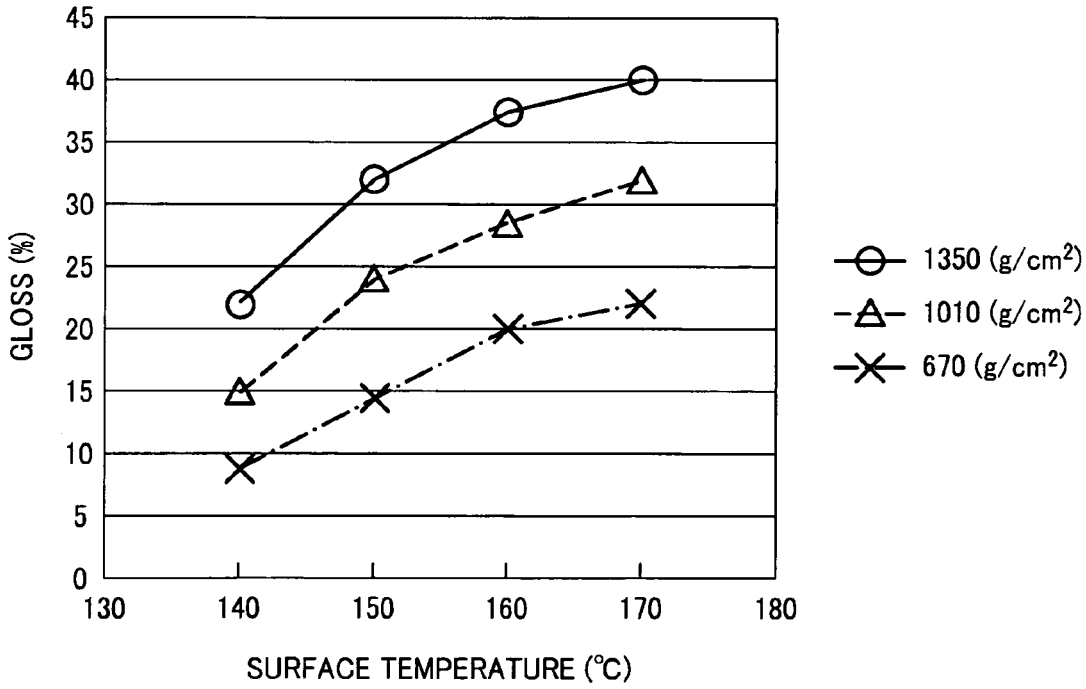
FIG 11 is a graph illustrating a relation between a surface temperature of a fixing belt and a pressing roller included in the fixing device shown in FIG. 2A and a gloss of a toner image formed on a sheet.

FIG. 11 is a graph illustrating a relation between a surface temperature of the fixing members (e.g., the fixing belt 224 and the pressing roller 221 depicted in FIG. 2A) and a gloss of a toner image formed on a recording medium (e.g., a sheet 29 depicted in FIG. 2A), when a pressure (e.g., a surface pressure) with which the fixing members nip the sheet is changed. The gloss was measured with a gloss meter GM-60 available from Konica Minolta Holdings, Inc. at an angle of 60 degrees.

A typical surface pressure for the fixing device 22 (depicted in FIG. 2A) is 1,010 g/cm$^2$. When the surface pressure is increased to 1,350 g/cm$^2$, the gloss is increased. When the surface pressure is decreased to 670 g/cm$^2$, the gloss is decreased. The surface pressure is peculiar to a specific fixing device and is subject to change according to property of toner used in the fixing device. Therefore, a center value and a variable range of the surface temperature should be set according to an applicable fixing device and toner.

As illustrated in FIG. 2A, when the fixing belt 224 and the pressing roller 221 nip a sheet 29 with a decreased pressure, the fixing belt 224 and the pressing roller 221 may nip various type of sheet 29. For example, when the fixing belt 224 and the pressing roller 221 nip a special recording medium, such as an envelope, with an increased pressure, the envelope may be creased. To address this problem, the position of the coil spring 233 may be adjusted so that the coil spring 233 is contracted more than as illustrated FIG. 2A. Accordingly, the fixing belt 224 and the pressing roller 221 may nip the envelope with a decreased pressure. As described above, when the pressure with which the fixing belt 224 and the pressing roller 221 nip the recording medium is adjusted, the fixing belt 224 and the pressing roller 221 may fix a toner image on the recording medium without creasing the recording medium. In this case, when the decreased pressure deteriorates fixing property, the temperature of the fixing belt 224 and the pressing roller 221 may be adjusted to provide a proper fixing property.

The adjustment of the pressure (e.g., a nip pressure) with which the fixing belt 224 and the pressing roller 221 nip the recording medium may continuously provide a desired gloss of the toner image on the recording medium. Thus, the fixing device 22 may handle various types of recording medium. According to the above-described example embodiments, the length of the coil spring 233 is adjusted to change the nip pressure with which the fixing belt 224 and the pressing roller 221 nip the recording medium. Alternatively, a position at which the shaft 234 supports the pressure application lever 230 or a contact position at which the bearing 229 contacts the pressure application lever 230 may be changed to change the nip pressure.

The structure of the fixing device 22 (depicted in FIG. 2A) is not limited to the structure shown in FIG. 2A. For example, the fixing members (e.g., the pressing roller 221 and the fixing belt 224 depicted in FIG. 2A) may be heated by an induction heater instead of a heater. Further, an identical heat source may heat both the pressing roller 221 and the fixing belt 224.

The structure of the image forming apparatus 1 (depicted in FIG. 1) is not limited to the structure shown in FIG. 1. For example, the image forming units 8Y, 8C, 8M, and 8K may be arranged in an order other than the order illustrated in FIG. 1. The image forming apparatus may include a single photoconductor around which a plurality of development devices is provided. Further, the image forming apparatus 1 may include a revolver type development device. According to the above-described example embodiment, the image forming apparatus 1 forms a color image by using toner in four colors (e.g., yellow, cyan, magenta, and black colors). Alternatively, the image forming apparatus 1 may form a color image by using two or three colors of toner or a monochrome image by using one color of toner.

The following describes toner used in the fixing device 22 (depicted in FIG. 2A), 22A (depicted in FIG. 6), 22B (depicted in FIG. 7), 22C (depicted in FIG. 8), 22D (depicted in FIG. 9A), and 22E (depicted in FIG. 10A) according to an example embodiment.

The toner is prepared by dissolving or dispersing a prepolymer including a modified polyester resin, a compound to elongate or cross-link with the prepolymer, and a toner constituent in an organic solvent to obtain a dissolved or dispersed liquid, elongating and/or cross-linking the dissolved or dispersed liquid in an aqueous medium to obtain a dispersion liquid, and removing a solvent from the dispersion liquid. In the following description, "and/or" means "at least one of".

Methods for developing an electrostatic latent image formed according to image data are used in various fields with image forming apparatuses using an electrophotographic method or an electrostatic recording method. In the electrophotographic method, for example, an electrostatic latent image is formed on a photoconductor (e.g., the photoconductor 10Y, 10C, 10M, or 10K depicted in FIG. 1) according to image data through charging and exposing processes. The electrostatic latent image is developed with a developer through a developing process. The developed image is transferred onto a recording medium through a transfer process. The transferred image is fixed through a fixing process.

The developer includes a one-component developer containing a magnetic toner or a non-magnetic toner and a two-component developer containing a toner and carriers.

A toner used as the developer in the electrophotographic method is generally produced in a mixing-kneading-pulverizing method in which a thermoplastic resin and a pigment are dissolved, mixed, and kneaded with a releasing agent, for example, wax and/or a charging control agent, as needed, and then pulverized and sized. To improve fluidity and cleaning property of the toner, inorganic or organic fine particles are added to surfaces of toner particles, as needed.

The toner particles produced in the mixing-kneading-pulverizing method generally have no definite shape, but have a broad particle size distribution, a low fluidity and transferability, a high fixing energy, a charging amount varying depending on toner particles, and a low charging stability. An image formed with those toner particles may provide insufficient image quality.

A polymerization method is proposed to solve the above problems of the toner particles produced in the mixing-kneading-pulverizing method. The polymerization method does not include kneading and pulverizing processes, resulting in cost reduction caused by energy saving, shortened production hours, and an improved yield of products. A sharper particle size distribution can be easily obtained with toner particles produced in the polymerization method than with the toner particles produced in the mixing-kneading-pulverizing method. In the polymerization method, wax can be easily contained inside the toner particles to improve fluidity of the toner particles and the toner particles can be easily formed in a spherical shape.

However, the toner particles produced in the polymerization method have problems. For example, a surface tension affecting the toner particles during a polymerization process produces toner particles having a sphericity higher than a sphericity of the toner particles produced in the mixing-kneading-pulverizing method. However, physical properties of the toner particles produced in the polymerization method are not sufficient. Further, in the polymerization method, it is not easy to control (e.g., vary) a shape of the toner particles. However, the polymerization method can have an advantage in producing toner particles having an improved charging stability and transferability.

The polymerization method includes a suspension polymerization method generally used. Monomers for a binder (e.g., a binder resin) used in the suspension polymerization method may be limited to a styrene monomer and an acrylic monomer harmful to humans. Toner particles produced in the suspension polymerization method contain those monomers and may cause environmental problems. Since wax is contained inside the toner particles, a decreased amount of the toner particles are adhered to a photoconductor (e.g., the photoconductor 10Y, 10C, 10M, or 10K depicted in FIG. 1). However, the toner particles produced in the suspension polymerization method may provide a lower fixing performance than the toner particles produced in the mixing-kneading-pulverizing method. For example, in the mixing-kneading-pulverizing method, wax is on an interface of the toner particle. In the suspension polymerization method, the wax contained inside the toner particles does not easily seep onto surfaces of the toner particles, resulting in a low fixing efficiency. Therefore, the toner particles produced in the suspension polymerization method (e.g., polymer toner particles)

may have a disadvantage in reducing energy consumption. If an amount of the wax or a dispersed particle size of the wax is increased to improve the fixing performance of the polymer toner particles, transparency of a color image may deteriorate when the polymer toner particles are used for forming the color image. Thus, the polymer toner particles are not suitable for forming a color image on an OHP (overhead projector) transparency used for presentation.

The polymerization method further includes an emulsion polymerization method which can vary the shape of toner particles. A monomer used in the emulsion polymerization method is limited to the styrene monomer. It may be difficult to completely remove an unreacted monomer, an emulsifier, and a dispersing agent from the toner particles, causing environmental problems.

A dissolution-suspension method is also known as a toner production method. The dissolution-suspension method may have an advantage in using a polyester resin enabling fixing at a low temperature. However, a high-molecular-weight component is added in a process of dissolving or dispersing a resin enabling fixing at a low temperature and a colorant in a solvent. Therefore, a liquid viscosity may increase, causing problems relating to production performance. Further, toner particles produced in the dissolution-suspension method are formed to have a spherical shape and a patterned indented surface in order to improve cleaning performance for the toner particles. However, those toner particles having an amorphous shape without regularity may lack charging stability and may have problems in durability and releasing property, providing insufficient quality.

A dry toner particle is proposed to improve fluidity, fixability at a low temperature, and hot offset resistance. The dry toner particle includes an elongated reactant of urethane-modified polyester as a toner binder and has a practical sphericity in a range of from 0.90 to 1.00. Another dry toner particle proposed can have an advantage in powder fluidity and transferability when formed as a toner particle having a small particle size as well as in heat-resistant preservation, fixability at a low temperature, and hot offset resistance. Methods for producing the above dry toner particles include a high-molecular-weight producing process of polyadding polyester prepolymer having an isocyanate group with amine in an aqueous medium.

However, in the polymer toner produced in any one of the above polymerization methods, a pigment is not properly dispersed and is unevenly dispersed in the toner. Thus, an image formed with the toner may have an inferior transparency and saturation (e.g., brightness). Particularly, when a color image is formed on an OHP transparency with the toner, the color image may become dark.

To address the above problems, an electrophotographic toner is proposed. The electrophotographic toner uses a polyester resin as a binder, in which a pigment colorant is highly dispersed to provide a high quality image having an improved transparency and saturation (e.g., brightness or gloss). The toner can provide an advantage in powder fluidity, hot offset resistance, charging stability, and transferability.

When using the electrophotographic toner, the image forming apparatus 1 (depicted in FIG. 1), the fixing device 22, 22A, 22B, 22C, 22D, or 22E can form an image having a further improved color reproduction, saturation, and transparency.

The following describes a composition 1 of the electrophotographic toner. The electrophotographic toner is prepared by dissolving or dispersing a prepolymer including a modified polyester resin, a compound to elongate or cross-link with the prepolymer, and a toner constituent in an organic solvent to obtain a dissolved or dispersed liquid (e.g., an oily dispersion liquid), elongating and/or cross-linking the dissolved or dispersed liquid in an aqueous medium to obtain a dispersion liquid, and removing a solvent from the dispersion liquid. A pigment colorant dispersed in the toner has a number average dispersed particle size not larger than about 0.5 μm. A number ratio of the pigment colorant having a number average particle size not smaller than about 0.7 μm is not greater than about 5 number percent.

The following describes compositions 2 to 8 of the electrophotographic toner, one or more of which is added to the above composition 1 of the electrophotographic toner.

The composition 2 of the electrophotographic toner has a feature in which the colorant dispersed in the toner has a number average dispersed particle size not larger than about 0.3 μm and a number ratio of the colorant having a number average particle size not smaller than about 0.5 μm is not greater than about 10 number percent.

The composition 3 of the electrophotographic toner has a feature in which the toner has a weight average particle size in a range of from about 3.0 μm to about 7.0 μm and a particle size distribution satisfy a following inequality:

$$1.00 \leqq Dv/Dn \leqq 1.20$$

In the above inequality, Dv represents a weight average particle size and Dn represents a number average particle size.

The composition 4 of the electrophotographic toner has a feature in which the toner has a circularity in a range of from about 0.900 to about 0.960.

The composition 5 of the electrophotographic toner has a feature in which a portion of a polyester resin contained in the toner which is soluble to tetrahydrofuran has a main peak in an area of a molecular weight in a range of from about 2,500 to about 10,000 in a molecular weight distribution and has a number average molecular weight in a range of from about 2,500 to about 50,000.

The composition 6 of the electrophotographic toner has a feature in which the polyester resin contained in the toner has a glass transition point in a range of from about 40 degrees centigrade to about 65 degrees centigrade and an acid number in a range of from about 1 mgKOH/g to about 30 mgKOH/g.

The composition 7 of the electrophotographic toner has a feature in which a polyester resin unreactive to an amine is dissolved in the oily dispersion liquid.

The composition 8 of the electrophotographic toner has a feature in which a developer includes the toner and carriers.

The toner can be used as either a black toner for forming a monochrome image or a color toner for forming a color image. The following describes details of the toner.

An oily dispersion liquid is obtained by at least dissolving a polyester prepolymer A having an isocyanate group, dispersing a pigment colorant, and dissolving or dispersing a releasing agent in an organic solvent. The oily dispersion liquid is dispersed in an aqueous medium in the presence of inorganic fine particles and/or polymer fine particles to obtain a dispersion liquid. The polyester prepolymer A is reacted with a polyamine and/or an amine B (e.g., monoamine) having an active hydrogen group in the dispersion liquid to obtain a urea-modified polyester resin C having a urea group. A fluid medium is removed from the dispersion liquid containing the urea-modified polyester resin C. Thus, the toner according to this example embodiment can be obtained. A dispersed substance denotes a component dissolved or dispersed in the oily dispersion liquid.

The urea-modified polyester resin C has a glass transition point in a range of from about 40 degrees centigrade to about 60 degrees centigrade, preferably in a range of from about 45 degrees centigrade to about 60 degrees centigrade, a number average molecular weight Mn in a range of from about 2,500 to about 50,000, preferably in a range of from about 2,500 to about 30,000, and a weight average molecular weight Mw in a range of from about 10,000 to about 500,000, preferably in a range of from about 30,000 to about 100,000.

The toner includes, as a binder resin, the urea-modified polyester resin C having a urea bond caused by a reaction between the polyester prepolymer A and the amine B to have a high molecular weight. A colorant is highly dispersed in the binder resin.

When the pigment colorant contained in toner particles is controlled to have a number average dispersed particle size not larger than about 0.5 μm and a number ratio of the pigment colorant having a number average particle size not smaller than about 0.7 μm is controlled to be not greater than about 5 percent, an obtained toner can have an advantage in fixability at a low temperature, charging stability, and fluidity and can produce a high quality image, particularly a color image having an improved transparency and gloss.

When the pigment colorant contained in toner particles is controlled to have a number average dispersed particle size not larger than about 0.3 μm and a number ratio of the pigment colorant having a number average particle size not smaller than about 0.5 μm is controlled to be not greater than about 10 percent, an obtained toner can have higher quality. The toner can have an advantage in producing an image having a high resolution and is suitable for a digital development device. Particularly, when the toner is used for forming a color image, the toner can have an advantage in producing an image having a high resolution and an improved transparency, and can produce a high quality color image having an improved color reproduction.

To produce the above toner in which the colorant is uniformly dispersed, it may be beneficial to improve conventional toner production methods because the conventional toner production methods cannot produce the above high quality toner.

To produce the above high quality toner, it may be beneficial to include a process of pulverizing the colorant (e.g., a wet pulverizing process) to produce the oily dispersion liquid containing the polyester prepolymer A, the colorant, and the releasing agent. A wet pulverizing device for performing the wet pulverizing process can be an arbitrary device as long as the wet pulverizing device can apply an impact to the colorant in the liquid so as to pulverize the colorant. Examples of the wet pulverizing device include various known wet pulverizing devices, such as a ball mill and a bead mill.

The wet pulverizing process is performed at a temperature in a range of from about 5 degrees centigrade to about 20 degrees centigrade and preferably in a range of from about 15 degrees centigrade to about 20 degrees centigrade. An adjustment of wet pulverizing conditions can control a dispersed particle size and a particle size distribution of the colorant contained in toner particles within the above range.

The wet pulverizing process can be applied to the dispersion liquid after reaction, as needed. To produce the above high quality toner, it is also possible to preferably use another method in which a colorant is dispersed in high concentrations in a resin to produce master batch colorant particles. The master batch colorant particles are added to an organic solvent as a colorant material, and are stirred and dispersed in the organic solvent. Use of the master batch colorant particles can produce a toner in which a colorant having a small, dispersed particle size is uniformly dispersed to produce a color image having an improved transparency.

To preferably produce the master batch colorant particles, a heat melting resin and a colorant are mixed and kneaded with a high shearing force at a melting temperature of the resin. A mixture obtained is cooled and solidified. Then, the solidified mixture is pulverized.

Examples of the resin include a thermoplastic resin miscible in the urea-modified polyester resin C produced from the polyester prepolymer A. A polyester resin is preferably used according to this example embodiment. The thermoplastic resin has a softening point in a range of from about 100 degrees centigrade to about 200 degrees centigrade, preferably in a range of from about 120 degrees centigrade to about 160 degrees centigrade, and a number average molecular weight Mn in a range of from about 2,500 to about 50,000, preferably in a range of from about 2,500 to about 30,000.

A concentration of the colorant in the master batch colorant particles is in a range of from about 10 weight percent to about 60 weight percent and preferably in a range of from about 25 weight percent to about 55 weight percent.

The following describes a method for measuring physical properties of a toner, such as a dispersed particle size and a particle size distribution of a pigment colorant contained in the toner. To measure the dispersed particle size and the particle size distribution of the colorant contained in the toner, a toner particle is embedded in an epoxy resin. The toner particle is cut into a thin slice of about 100 nm with a microtome MT6000-XL available from Meiwa Shoji, Co., Ltd. to prepare a measurement sample.

The sample is photographed with a transmission electron microscope H-9000NAR available from Hitachi, Ltd. at an acceleration voltage of 100,000 V to produce a plurality of TEM (transmission electron microscope) photographs in a range of from 10,000 magnifications to 40,000 magnifications. Image information obtained from the plurality of photographs is converted into image data with an image analyzer LUZEX III available from NIRECO Corporation. Pigment colorant particles having a particle size not smaller than about 0.1 μm are selected at random and measured until sampling is performed for 300 times or more so as to calculate an average particle size and a particle size distribution.

The high quality toner according to this example embodiment has a weight average particle size Dv in a range of from about 3 μm to about 7 μm. A proportion Dv/Dn of the weight average particle size Dv to a number average particle size Dn is set to not less than about 1.00 and not more than about 1.20. Thus, a toner capable of producing an image having a high resolution and high quality can be obtained. To produce a higher quality image, the weight average particle size Dv of the toner may be set in a range of from about 3 μm to about 7 μm. The proportion Dv/Dn may be set to not less than about 1.00 and not more than about 1.20. A number ratio of toner particles having a particle size not larger than about 3 μm may be set in a range of from about 1 number percent to about 10 number percent. Preferably, the weight average particle size Dv may be set in a range of from about 3 μm to about 6 μm. The proportion Dv/Dn may be set to not less than about 1.00 and not more than about 1.15. The toner produced as described above can have an advantage in heat-resistant preservation, fixability at a low temperature, and hot offset resistance. Particularly, the toner produces an image having an improved gloss when used in a color copier. When the toner is used as a two-component developer while a cyclic operation of consumption and replenishment of the toner is repeated for a long period of time, the particle size of toner particles in the two-component developer may hardly change, thereby leading to an improved and stable development even if the toner particles are stirred in the development device 12Y, 12C, 12M, or 12K (depicted in FIG. 1) for a long period of time.

Generally, the smaller particle size a toner has, the higher quality and resolution an image produced with the toner has. However, the smaller particle size a toner has, the poorer transferability and cleaning property the toner has. When a toner has a weight average particle size smaller than the weight average particle size specified herein according to this example embodiment, toner particles may adhere to surfaces of carriers contained in the two-component developer while the two-component developer is stirred for a long period of time in the development device 12Y, 12C, 12M, or 12K, resulting in deterioration of charging ability of the carriers. When a toner having a small weight average particle size is used as a one-component developer, a toner film may be formed on a development roller (e.g., the development device 12Y, 12C, 12M, or 12K depicted in FIG. 1) and toner particles may adhere to a member, such as a blade configured to regulate the toner particles to form a thin toner layer. An amount of fine toner particles contained in the toner may substantially relate to the above problems. Particularly, when an amount of toner particles having a particle size not larger than about 3 μm occupies more than about 10 percent of an amount of all toner particles, the toner particles may not easily adhere to carriers and it may be difficult to maintain charging stability at a high level.

When the toner has an average particle size larger than that specified herein according to this example embodiment, it may be difficult to produce an image having a high resolution and high quality. When the cyclic operation of consumption and replenishment of the toner is repeated, the particle size of the toner tends to substantially change. This is also true when a proportion of the weight average particle size to the number average particle size is more than about 1.20.

The average particle size and the particle size distribution of a toner are measured in a Coulter counter method. The particle size distribution is measured with a measuring device, such as Coulter Counter TA-II or Coulter Multisizer II available from Beckman Coulter, Inc. According to this example embodiment, Coulter Counter TA-II was connected to an interface for outputting a number distribution and a volume distribution available from the Institute of the Japanese Union of Scientists and Engineers and a personal computer PC9801 available from NEC Corporation so as to measure the particle size distribution.

The following describes a method for measuring a number distribution and a volume distribution of toner particles. A surfactant, preferably alkyl benzene sulfonate, in an amount in a range of from about 0.1 ml to about 5.0 ml serving as a dispersing agent is added to an aqueous electrolysis solution in an amount in a range of from about 100 ml to about 150 ml. An example of the aqueous electrolysis solution includes an aqueous solution of NaCl at about 1 percent which is prepared by using a first grade NaCl, such as ISOTON-II available from Beckman Coulter, Inc. A sample toner in an amount in a range of from about 2 mg to about 20 mg is added to the aqueous electrolysis solution. The aqueous electrolysis solution in which the sample toner is suspended is dispersed with an ultrasonic disperser for a period of time in a range of from about 1 minute to about 3 minutes. Volumes and numbers of toner particles contained in the sample toner are measured with the measuring device by using a 100 μm aperture to calculate the number distribution and the volume distribution of the toner particles.

Following 13 channels were used to measure particle sizes not smaller than 2.00 μm and smaller than 40.30 μm. For example, the channels included particle sizes not smaller than 2.00 μm and smaller than 2.52 μm, not smaller than 2.52 μm and smaller than 3.17 μm, not smaller than 3.17 μm and smaller than 4.00 μm, not smaller than 4.00 μm and smaller than 5.04 μm, not smaller than 5.04 μm and smaller than 6.35 μm, not smaller than 6.35 μm and smaller than 8.00 μm, not smaller than 8.00 μm and smaller than 10.08 μm, not smaller than 10.08 μm and smaller than 12.70 μm, not smaller than 12.70 μm and smaller than 16.00 μm, not smaller than 16.00 μm and smaller than 20.20 μm, not smaller than 20.20 μm and smaller than 25.40 μm, not smaller than 25.40 μm and smaller than 32.00 μm, and not smaller than 32.00 μm and smaller than 40.30 μm.

The weight average particle size Dv calculated from the volume distribution and the number average particle size Dn calculated from the number distribution of the high quality toner particles according to this example embodiment were used to calculate the proportion Dv/Dn.

Various methods are proposed to produce a toner having hot offset resistance, such as a method for controlling a molecular weight distribution of a binder resin. Methods for producing a toner having contradictory properties, for example, fixability at a low temperature and hot offset resistance, include a method using a binder resin having a broader molecular weight distribution and a method using a mixed resin having at least two molecular weight peaks and including a high molecular weight component having a molecular weight of hundred-thousands to millions and a low molecular weight component having a molecular weight of thousands to tens of thousands. The high molecular weight component when having a cross-linking structure or being gelled, effectively produces the toner having hot offset resistance. However, it is not preferable to add a large amount of the high molecular weight component to a toner used for forming a color image for which transparency and gloss are required. The toner according to this example embodiment includes the urea-modified polyester resin having the urea bond as the high molecular weight component. Thus, the toner can have an improved hot offset resistance while the toner is transparent and glossy.

The following describes GPC (gel permeation chromatography) for measuring a molecular weight distribution of a binder resin component contained in the toner according to this example embodiment.

A column is stabilized in a heat chamber at about 40 degrees centigrade. A THF (tetrahydrofuran) as a column solvent at about 40 degrees centigrade is flown at a flow velocity of about 1 ml per minute. A THF sample solution in an amount in a range of from about 50 μl to about 200 μl containing a resin adjusted at a sample concentration in a range of from about 0.05 weight percent to about 0.6 weight percent is added.

The molecular weight distribution is calculated based on a relation between a logarithmic value and a number of counts of a calibration curve created by several types of monodisperse polystyrene standard samples. The polystyrene standard samples are available from Pressure Chemical Co. or Toyo Soda Manufacturing Co. and have molecular weights of 6×102, 2.1×102, 4×102, 1.75×104, 1.1×105, 3.9×105, 8.6×105, 2×106, and 4.48×106. At least 10 polystyrene standard samples are used to create the calibration curve. An RI (refractive index) detector is used as a detector.

The molecular weight distribution of the binder resin component contained in the toner generally includes a main peak molecular weight in a range of from about 2,500 to about 10,000, preferably in a range of from about 2,500 to about 8,000, and more preferably in a range of from about 2,500 to about 6,000. When an amount of the binder resin component having a molecular weight smaller than about 1,000 increases, heat-resistant preservation of the toner tends to deteriorate. When an amount of the binder resin component having a molecular weight not smaller than about 30,000 increases, fixability of the toner at a low temperature tends to deteriorate. However, balance control can suppress the deterioration. The amount of the binder resin component having the molecular weight not smaller than about 30,000 occupies a range of from about 1 percent to about 10 percent and preferably a range of from about 3 percent to about 6 percent, but varies depending on toner materials. When the amount of the binder resin component having the molecular weight not smaller than about 30,000 occupies less than about 1 percent, hot offset resistance of the toner may not be sufficient. When the amount of the binder resin component having the molecular weight not smaller than about 30,000 occupies more than about 10 percent, the toner may not be sufficiently transparent and glossy.

The number average molecular weight Mn of the binder resin contained in the toner is in a range of from about 2,500 to about 50,000. The proportion Mw/Mn of the weight average molecular weight Mw to the number average molecular weight Mn is not more than about 10. When the proportion Mw/Mn exceeds about 10, the toner may lack sharp melting property and may not be sufficiently glossy.

A circularity of the toner according to this example embodiment is measured with a flow-type particle image analyzer FPIA-2000 available from SYSMEX CORPORATION.

An average circularity of the toner according to this example embodiment is in a range of from about 0.900 to about 0.960. It is important that toner particles contained in the toner have a specific shape and shape distribution. When the average circularity is smaller than about 0.900, the toner particles may have an amorphous shape, may not provide satisfactory transferability, and may not produce a high quality image without background fogging. The amorphous-shaped toner particles include a substantial number of contact points to a smooth medium such as a photoconductor (e.g., the photoconductor 10Y, 10C, 10M, or 10K depicted in FIG. 1). The amorphous-shaped toner particles also include projecting points on which electric charge is concentrated, and have a van der Waals force and an image force stronger than those of spherical toner particles. Therefore, in an electrostatic transfer process, the spherical toner particles are selectively transferred in a toner in which the amorphous-shaped toner particles and the spherical toner particles are mixed, resulting in white spots on characters and lines on a produced image. A cleaner (e.g., the cleaner 13Y, 13C, 13M, or 13K depicted in FIG. 1) may be required to remove toner particles remaining on a photoconductor (e.g., the photoconductor 10Y, 10C, 10M, or 10K depicted in FIG. 1) before a next developing process starts. A toner yield, that is, a rate of a toner used for image forming, may also decrease. A circularity of a pulverized toner, which is measured with the flow-type particle image analyzer FPIA-2000, is usually in a range of from about 0.910 to about 0.920.

It is preferable to use an optical detection area method to measure the circularity of a toner. In the optical detection area method, a suspension liquid containing toner particles passes an image detecting area on a flat plate. A CCD (charge-coupled device) camera optically detects and analyzes images of the toner particles. The optical detection area method calculates a projected area of a toner particle.

A circularity Ci of a toner particle is calculated by a following equation:

$$Ci=Cs/Cp$$

In the above equation, Cp represents a circumferential length of a toner particle, and Cs represents a circumferential length of a circle having a same area as the projected image of the toner particle.

The circularity Ci of the tone particle is measured with the flow-type particle image analyzer FPIA-2000 as an average circularity. Specifically, a surfactant as a dispersing agent, preferably alkyl benzene sulfonate in an amount in a range of from about 0.1 ml to about 0.5 ml, is added in a container containing water in an amount in a range of from about 100 ml to about 150 ml from which solid impurities have been removed. A measurement sample in an amount in a range of from about 0.1 g to about 0.5 g is added to the water to produce a suspension liquid. The suspension liquid is dispersed for a period of time in a range of from about 1 minute to about 3 minutes with the ultrasonic disperser to produce a dispersion liquid having a concentration in a range of from about 3,000 to about 10,000 particles per μl. The flow-type particle image analyzer FPIA-2000 measures shapes of the toner particles and a toner particle shape distribution.

The method for producing the toner according to this example embodiment includes the high-molecular-weight producing process. In the process, the polyester prepolymer A having the isocyanate group is dispersed in the aqueous medium including the inorganic fine particles and/or the polymer fine particles, and is reacted with the amine B. In this case, the polyester prepolymer A having the isocyanate group can be produced by reacting a polyester, which is a polycondensate of a polyol PO and a polycarboxylic acid PC and has the active hydrogen group, with a polyisocyanate PIC. Examples of the active hydrogen group include hydroxyl groups (e.g., an alcoholic hydroxyl group and a phenolic hydroxyl group), amino groups, carboxyl groups, mercapto groups, and the like. Among those, the alcoholic hydroxyl group is preferred.

Examples of the polyol PO include a diol DIO and a trivalent or more polyol TO. The diol DIO alone or a mixture of the diol DIO and a small amount of the trivalent or more polyol TO is preferred. Examples of the diol DIO include alkylene glycols (e.g., ethylene glycol, 1,2-propylene glycol, and the like), bisphenols (e.g., bisphenol A, bisphenol F, bisphenol S, and the like), alkylene oxide (e.g., ethylene oxide, propylene oxide, butylene oxide, and the like) adducts of the above bisphenols, and the like. Among those, the alkylene glycols having a carbon number of 2 to 12 and the alkylene oxide adducts of the above bisphenols are preferred. It is more preferable to use both the alkylene oxide adducts of the above bisphenols and the alkylene glycols having the carbon number of 2 to 12. Examples of the trivalent or more polyol TO include polyvalent (e.g., trivalent to octavalent or more) aliphatic alcohols (e.g., glycerin, trimethylol ethane, trimethylol propane, pentaerythritol, sorbitol, and the like), trivalent or more polyphenols (e.g., trisphenol PA, phenol novolac, cresol novolac, and the like), alkylene oxide adducts of the above trivalent or more polyphenols, and the like.

Examples of the polycarboxylic acid PC include a dicarboxylic acid DIC and a trivalent or more polycarboxylic acid TC. The dicarboxylic acid DIC alone or a mixture of the dicarboxylic acid DIC and a small amount of the trivalent or more polycarboxylic acid TC is preferred. Examples of the dicarboxylic acid DIC include alkylene dicarboxylic acids (e.g., succinic acid, adipic acid, sebacic acid, and the like), alkenylene dicarboxylic acids (e.g., maleic acid, fumaric acid, and the like), aromatic dicarboxylic acids (e.g., phthalic acid, isophthalic acid, terephthalic acid, naphthalene dicarboxylic acid, and the like), and the like. Among those, the alkenylene dicarboxylic acids having a carbon number of 4 to 20 and the aromatic dicarboxylic acids having a carbon number of 8 to 20 are preferred. Examples of the trivalent or more polycarboxylic acid TC include aromatic polycarboxylic acids having a carbon number of 9 to 20 (e.g., trimellitic acid, pyromellitic acid, and the like), and the like. Examples of the polycarboxylic acid PC further include acid anhydrides of the above or lower alkyl esters (e.g., methyl ester, ethyl ester, isopropyl ester, and the like), which are reacted with the polyol PO.

A ratio of the polyol PO to the polycarboxylic acid PC is represented by an equivalent ratio OH/COOH of the hydroxyl group (OH) to the carboxyl group (COOH), which is usually in a range of from about 2/1 to about 1/1, preferably in a range of from about 1.5/1 to about 1/1, and more preferably in a range of from about 1.3/1 to about 1.02/1.

Examples of the polyisocyanate PIC include aliphatic polyisocyanates (e.g., tetramethylene diisocyanate, hexamethylene diisocyanate, 2,6-diisocyanate methylcaproate, and the like), alicyclic polyisocyanates (e.g., isophorone diisocyanate, cyclohexylmethane diisocyanate, and the like), aromatic diisocyanates (e.g., tolylene diisocyanate, diphenylmethane diisocyanate, and the like), aromatic, aliphatic diisocyanates (e.g., α,α,α',α'-tetramethyl xylylene diisocyanate and the like), isocyanurates, the above polyisocyanates blocked by phenolic derivatives, oximes, caprolactams, and/or the like, and a combination of two or more substances described above.

To obtain the polyester prepolymer having the isocyanate group, a ratio of the polyisocyanate PIC to an unmodified polyester resin PE having the active hydrogen group is represented by an equivalent ratio NCO/OH of the isocyanate group (NCO) to the hydroxyl group (OH) of the polyester having the hydroxyl group, which is usually in a range of from about 5/1 to about 1/1, preferably in a range of from about 4/1 to about 1.2/1, and more preferably in a range of from about 2.5/1 to about 1.5/1. When the ratio NCO/OH of the isocyanate group to the hydroxyl group exceeds about 5, fixability of the toner at a low temperature may deteriorate. When a molar ratio of the isocyanate group is less than about 1 and the urea-modified polyester is used, an amount of urea contained in the urea-modified polyester may decree, resulting in deterioration of hot offset resistance of the toner. An amount of a component of the polyisocyanate PIC contained in the polyester prepolymer A having the isocyanate group at an end usually occupies a rate in a range of from about 0.5 weight percent to about 40 weight percent, preferably in a range of from about 1 weight percent to about 30 weight percent, and more preferably in a range of from about 2 weight percent to about 20 weight percent. When the amount of the component of the polyisocyanate PIC occupies a rate of less than about 0.5 weight percent, hot offset resistance of the toner may deteriorate, and the toner may have a disadvantage in improving both heat-resistant preservation and fixability at a low temperature. When the amount of the component of the polyisocyanate PIC occupies a rate of more than about 40 weight percent, fixability of the toner at a low temperature may deteriorate.

A number of the isocyanate groups contained in one molecule of the polyester prepolymer A having the isocyanate group is usually not less than about 1, preferably in a range of from about 1.5 to about 3 on average, and more preferably in a range of from about 1.8 to about 2.5 on average. When the number of the isocyanate groups is less than about 1, a molecular weight of the urea-modified polyester obtained may decrease, resulting in deterioration of hot offset resistance of the toner.

Examples of the amine B include polyamines and/or monoamines having the active hydrogen group. Examples of the active hydrogen group include the hydroxyl group and the mercapto group.

Examples of the amine B further include diamine compounds B1, polyamine (e.g., trivalent or more) compounds B2, and the like. Examples of the diamine compounds B1 include aromatic diamines (e.g., phenylene diamine, diethyltoluene diamine, 4;4'-diaminodiphenyl methane, and the like) and the like. Examples of the polyamine compounds B2 include diethylene triamine, triethylene tetramine, and the like. Among the above amines B, the diamine compounds B1 and a mixture of the diamine compounds B1 and a small amount of the polyamine compounds B2 are preferred.

To react the polyester prepolymer A with the amine B, an elongation stopper may be used to adjust the molecular weight of the urea-modified polyester, as needed. The elongation stopper includes monoamines without the active hydrogen group (e.g., diethylamine, dibutylamine, butylamine, laurylamine, and the like), amines blocking the above (e.g., a ketimine compound), and the like. An amount of the elongation stopper can be properly selected based on a desired molecular weight of the urea-modified polyester to be generated.

A ratio of the polyester prepolymer A having the isocyanate group to the amine B is represented by an equivalent ratio NCO/NHx of the isocyanate group (NCO) of the polyester prepolymer A having the isocyanate group to the amino group (NHx where x represents 1 or 2) of the amine B, which is usually in a range of from about 1/2 to about 2/1, preferably in a range of from about 1.5/1 to about 1/1.5, and more preferably in a range of from about 1.2/1 to about 1/1.2. When the ratio NCO/NHx is more than about 2/1 or less than about 1/2, the molecular weight of the urea-modified polyester may decrease, resulting in deterioration of hot offset resistance of the toner.

When reacting the polyester prepolymer A having the isocyanate group with the amine B in the aqueous medium in the method for producing the toner according to this example embodiment, a polyester resin D unreactive to the amine B can be added to the aqueous medium, as needed. The unreactive polyester resin D has a glass transition point in a range of from about 35 degrees centigrade to about 65 degrees centigrade, preferably in a range of from about 45 degrees centigrade to about 60 degrees centigrade, and a number average molecular weight Mn in a range of from about 2,000 to about 10,000, preferably in a range of from about 2,500 to about 8,000. An example of the unreactive polyester resin D includes a urea-modified polyester UMPE. The urea-modified polyester UMPE may contain a urea bond as well as a urethane bond. A molar ratio of an amount of the contained urea bond to an amount of the contained urethane bond is usually in a range of from about 100/0 to about 10/90, preferably in a range of from about 80/20 to about 20/80, and more preferably in a range of from about 60/40 to about 30/70. When the molar ratio of the urea bond is less than about 10 percent, hot offset resistance of the toner may deteriorate.

The urea-modified polyester UMPE is produced in a known technology such as a one-shot method. A weight average molecular weight of the urea-modified polyester UMPE is usually not less than about 10,000, preferably in a range of from about 20,000 to about 500,000, and more preferably in a range of from about 30,000 to about 100,000. When the weight average molecular weight is less than about 10,000, hot offset resistance of the toner may deteriorate.

In the method for producing the toner according to this example embodiment, a toner binder may contain only the urea-modified polyester resin UMPE which is used as needed, or both the urea-modified polyester resin UMPE and the unmodified polyester resin PE. When the toner binder contains both the urea-modified polyester resin UMPE and the unmodified polyester resin PE, the toner may improve fixability at a low temperature and produce a more glossy color image. Thus, it is preferable for the toner binder to contain both the urea-modified polyester resin UMPE and the unmodified polyester resin PE. An example of the unmodified polyester resin PE includes a compound produced by polycondensation of the polyol PO and the polycarboxylic acid PC. Examples of the polyol PO and the polycarboxylic acid PC include those of the urea-modified polyester resin UMPE. The unmodified polyester resin PE preferably has a molecular weight similar to that of the urea-modified polyester resin UMPE. The unmodified polyester resin PE may be modified by a chemical bond other than the urea bond, for example, the urethane bond. It is preferable that the urea-modified polyester resin UMPE and the unmodified polyester resin PE are at least partially compatible to improve fixability at a low temperature and hot offset resistance of the toner. Therefore, the urea-modified polyester resin UMPE and the unmodified polyester resin PE have a similar polyester composition. A weight ratio of the urea-modified polyester resin UMPE to the unmodified polyester resin PE is usually in a range of from about 5/95 to about 80/20, preferably in a range of from about 5/95 to about 30/70, more preferably in a range of from about 5/95 to about 25/75, and even more preferably in a range of from about 7/93 to about 20/80. When the urea-modified polyester resin UMPE occupies less than about 5 percent, hot offset resistance of the toner may deteriorate and the toner may have a disadvantage in improving both heat-resistant preservation and fixability at a low temperature.

The unmodified polyester resin PE preferably has a hydroxyl number not smaller than about 5 mgKOH/g. An acid number of the unmodified polyester resin PE is usually in a range of from about 1 mgKOH/g to about 30 mgKOH/g and preferably in a range of from about 5 mgKOH/g to about 20 mgKOH/g. When the unmodified polyester resin PE has the acid number, the toner can easily be negative-charged and can have an affinity to a recording medium (e.g., a sheet) while a toner image is fixed on the sheet, resulting in an improved fixability of the toner at a low temperature. However, when the acid number of the unmodified polyester resin PE exceeds about 30 mgKOH/g, charging stability of the toner tends to deteriorate especially when an environmental condition changes. In a polyaddition reaction between the polyester prepolymer A and the amine B, variation in the acid number may cause variation in toner particle size in a granulation process, resulting in difficulty in emulsification.

According to this example embodiment, a glass transition point of the toner binder is usually in a range of from about 45 degrees centigrade to about 65 degrees centigrade and preferably in a range of from about 45 degrees centigrade to about 60 degrees centigrade. When the glass transition point is lower than about 45 degrees centigrade, heat resistance of the toner may deteriorate. When the glass transition point is higher than about 65 degrees centigrade, the toner may provide insufficient fixability at a low temperature.

Various known pigments can be used as the pigment colorant in the method for producing the toner according to this example embodiment. Examples of the pigment colorant include carbon black, nigrosine, Anthiaquinone Green, titanium oxide, zinc white, lithopone, and a mixture of those. The pigment colorant content in the toner is usually in a range of from about 1 weight percent to about 15 weight percent and preferably in a range of from about 3 weight percent to about 10 weight percent.

As described above, the pigment colorant according to this example embodiment is preferably used as master batch colorant particles complexed with a resin. Examples of the binder resin mixed and kneaded with the pigment colorant for producing a master batch include polystyrene, terpene resins, aliphatic or alicyclic hydrocarbon resins, aromatic petroleum resins, and the like as well as the above polyester resins modified and not modified. Any one of the above resins or a mixture of the above resins can be used.

The master batch can be produced by mixing and kneading the resin and the colorant for the master batch with a high shearing force. In this case, an organic solvent can be used to enhance an interaction between the colorant and the resin. A flushing method is also preferred. In the flushing method, a water-based paste containing water of the colorant is mixed and kneaded with the resin and the organic solvent. The colorant is transferred to the resin. The water and the organic solvent are removed to use a wet cake of the colorant without drying the wet cake. A high shearing dispersion device, such as a three-roll mill, is preferably used for mixing and kneading.

The toner according to this example embodiment includes a releasing agent (e.g., wax) as well as the toner binder and the colorant. Various known waxes can be used as the releasing agent, for example, polyolefin waxes, long chain hydrocarbons, waxes having a carbonyl group, and the like. Among those, the waxes having the carbonyl group are preferred. Examples of the waxes having the carbonyl group include polyalkanoic acid esters, polyalkanol esters, dialkyl ketones (e.g., distearyl ketone and the like), and the like. Among those waxes having the carbonyl group, the polyalkanoic acid esters are preferred. A melting point of the wax is usually in a range of from about 40 degrees centigrade to about 160 degrees centigrade, preferably in a range of from about 50 degrees centigrade to about 120 degrees centigrade, and more preferably in a range of from about 60 degrees centigrade to about 90 degrees centigrade. The wax having the melting point lower than about 40 degrees centigrade may negatively affect heat-resistant preservation of the toner. The wax having the melting point higher than about 160 degrees centigrade may easily cause a cold offset during fixing at a low temperature. A melting viscosity of the wax, when measured at a temperature that is 20 degrees centigrade higher than the melting point, is preferably in a range of from about 5 cps to about 1,000 cps and more preferably in a range of from about 10 cps to about 100 cps. The wax having the melting viscosity higher than about 1,000 cps may hardly improve hot offset resistance and fixability at a low temperature of the toner. The wax content in the toner is usually in a range of from about 0 weight percent to about 40 weight percent and preferably in a range of from about 3 weight percent to about 30 weight percent.

The toner according to this example embodiment may include a charging control agent, as needed. Various known charging control agents can be used as the charging control agent, for example, nigrosine dyes, triphenylmethane dyes, quinacridone pigments, azo pigments, high polymers having a sulfonic acid group, the carboxyl group, and a functional group such as a quaternary ammonium salt, and the like.

An amount of the charging control agent used in the method for producing the toner according to this example embodiment is not uniquely determined, but is determined based on type of the binder resin, additives used as needed, and a toner production method including a dispersion method. The amount of the charging control agent is in a range of from about 0.1 parts by weight to about 10 parts by weight and preferably in a range of from about 0.2 parts by weight to about 5 parts by weight against the binder resin of 100 parts by weight. When the amount of the charging control agent exceeds about 10 parts by weight, the toner may be overly charged. Effects of the charging control agent may decrease and the toner may be strongly electrostatic-attracted to a development roller (e.g., the development device 12Y, 12C, 12M, or 12K depicted in FIG. 1), resulting in a decreased fluidity of the developer and a decreased image density. The charging control agent and the releasing agent can be melted, mixed, and kneaded with the master batch and the resin. The charging control agent can also be added when dissolved and dispersed in the organic solvent.

Inorganic fine particles can be preferably used as an additive for supporting fluidity, developing ability, and chargeability of toner particles containing the colorant according to this example embodiment. A primary particle size of the inorganic fine particle is preferably in a range of from about 5 mμ to about 2 μm and more preferably in a range of from about 5 mμ to about 500 mμ. A specific surface area measured in a BET (Brunauer, Emmet, Teller) method is preferably in a range of from about 20 $m^2/g$ to about 500 $m^2/g$. The inorganic fine particles used in the toner preferably occupy a rate in a range of from about 0.01 weight percent to about 5.0 weight percent and more preferably occupy a rate in a range of from about 0.01 weight percent to about 2.0 weight percent. Examples of the inorganic fine particles include silica, silicon nitride, and the like.

High polymer fine particles can also be used as the additive. Examples of the high polymer fine particles include a polystyrene copolymer, a methacrylic acid ester copolymer, and an acrylic acid ester copolymer obtained by soap-free emulsion polymerization, suspension polymerization, or dispersion polymerization, silicon, benzo guanamine, and nylon obtained by polycondensation, polymer particles obtained by a thermosetting resin, and the like.

A surface treatment agent may be used as another additive for applying a surface treatment on a toner particle to improve hydrophobic property of the toner particle and to prevent deterioration of fluidity or chargeability of the toner particle even at a high humidity. Examples of the surface treatment agent include a silane coupling agent, a silylation agent, a silane coupling agent having an alkyl fluoride group, an organic titanate coupling agent, an aluminum coupling agent, a silicone oil, a modified silicone oil, and the like.

A cleaning agent may be used as yet another additive for removing the developer remaining on a photoconductor (e.g., the photoconductor 10Y, 10C, 10M, or 10K depicted in FIG. 1) or a primary transfer medium (e.g., the intermediate transfer belt 7A depicted in FIG. 1) after a toner image is transferred. Examples of the cleaning agent include fatty acid metallic salts (e.g., zinc stearate, calcium stearate, stearic acid, and the like), polymer fine particles produced by soap-free emulsion polymerization (e.g., a polymethyl methacrylate fine particle, a polystyrene fine particle, and the like), and the like. The polymer fine particles preferably have a relatively narrow particle size distribution and a volume average particle size in a range of from about 0.01 μm to about 1 μm.

The following describes processes for producing the toner according to this example embodiment. In an oily dispersion liquid preparation process, the polyester prepolymer A having the isocyanate group, a colorant, and a releasing agent are dissolved or dispersed in an organic solvent to prepare an oily dispersion liquid.

In a wet pulverization process, the oily dispersion liquid is pulverized with a wet pulverization device for a period of time in a range of from about 30 minutes to about 120 minutes to pulverize and uniformly disperse the colorant in the oily dispersion liquid.

In a dispersion (e.g., emulsification) process, the oily dispersion liquid is dispersed (e.g., emulsified) in an aqueous medium in the presence of inorganic fine particles and/or polymer fine particles to prepare an oil-in-water dispersion (e.g., emulsified) liquid. In a reaction process, the polyester prepolymer A having the isocyanate group is reacted with the amine B in the dispersion liquid to prepare a urea-modified polyester resin C having a urea bond.

The organic solvent contains a polyester resin dissolved therein and is insoluble, or hardly or slightly soluble in water. A boiling point of the organic solvent is usually in a range of from about 60 degrees centigrade to about 150 degrees centigrade and preferably in a range of from about 70 degrees centigrade to about 120 degrees centigrade. Examples of the organic solvent include ethyl acetate, methyl ethyl ketone, and the like.

The above-described master batch colorant particles can be preferably used as the colorant so that the colorant can be effectively and uniformly dispersed. According to this example embodiment, the unreactive polyester resin D, which is unreactive to the amine B, can be preferably dissolved as a supplementary component in the organic solvent. Alternatively, the unreactive polyester resin D can be dispersed in the aqueous medium.

A dispersion device for dispersing the oily dispersion liquid in the aqueous medium is not limited and known dispersion devices using a low-speed shearing method, a high-speed shearing method, a friction method, a high-pressure jet method, and a ultrasonic method can be used as the dispersion device. The dispersion device using the high-speed shearing method can be preferably used to produce a dispersion particle having a particle size in a range of from about 2 μm to about 20 μm. A number of rotations of the dispersion device using the high-speed shearing method is not restricted, but is usually in a range of from about 1,000 rpm to about 30,000 rpm and preferably in a range of from about 5,000 rpm to about 20,000 rpm. A dispersion period of time is not restricted, but is usually in a range of from about 0.1 minute to about 5 minutes for a batch method. A dispersion temperature is usually in a range of from about 0 degrees centigrade to about 150 degrees centigrade under pressure and preferably in a range of from about 40 degrees centigrade to about 98 degrees centigrade. High temperatures are preferred to produce the dispersion liquid having a low viscosity and to easily disperse the dispersion liquid.

An amount of the aqueous medium against 100 parts by weight of toner solids, such as the polyester prepolymer A, the colorant, the releasing agent, and the unreactive polyester resin D contained in the oily dispersion liquid, is usually in a range of from about 50 parts by weight to about 2,000 parts by weight and preferably in a range of from about 100 parts by weight to about 1,000 parts by weight. When the amount of the aqueous medium is less than about 50 parts by weight, the toner solids may not be properly dispersed and toner particles having a predetermined particle size may not be obtained. When the amount of the aqueous medium is more than about 2,000 parts by weight, toner particles may not be produced at a reasonable cost. A dispersing agent can be used, as needed. The dispersing agent can be preferably used to create a sharp particle size distribution and to perform stable dispersion.

It is preferable that it takes time as short as possible before dispersing the oily dispersion liquid in the aqueous medium after the oily dispersion liquid is wet-pulverized.

The aqueous medium may include water only or water and a solvent miscible with water. Examples of the solvent miscible with water include alcohols (e.g., methanol, isopropanol, ethylene glycol, and the like), dimethylformamide, tetrahydrofuran, cellosolves (e.g., methyl cellosolve and the like), lower ketones (e.g., acetone, methyl ethyl ketone, and the like), and the like.

Various surfactants (e.g., emulsifiers) can be used as a dispersing agent for emulsifying and dispersing an oily phase containing the toner solids in a liquid containing water (e.g., an aqueous medium). Examples of the surfactants include anionic surfactants (e.g., alkyl benzene sulfonate, α-olefin sulfonate, ester phosphate, and the like), amine salt cationic surfactants (e.g., alkylamine salt, amino alcohol fatty acid derivative, polyamine fatty acid derivative, imidazoline, and the like), quaternary ammonium salt cationic surfactants (e.g., alkyl trimethyl ammonium salt, dialkyl dimethyl ammonium salt, alkyl dimethyl benzyl ammonium salt, pyridinium salt, alkyl isoquinolinium salt, benzethonium chloride, and the like), nonionic surfactants (e.g., fatty acid amide derivative, polyalcohol derivative, and the like), amphoteric surfactants (e.g., alanine, dodecyldi (aminoethyl)glycin, di(octyl aminoethyl)glycin, N-alkyl-N,N-dimethyl ammonium betaine, and the like), and the like.

A small amount of a surfactant having a fluoroalkyl group can be effectively used according to this example embodiment. Examples of the preferred anionic surfactant having the fluoroalkyl group include fluoroalkyl carboxylic acids having a carbon number of 2 to 10 and metallic salts thereof, disodium perfluonaoctane sulfonylglutamate, sodium 3-[omega-fluoroalkyl (C6 to C11) oxy]-1-alkyl (C3 to C4) sulfonate, sodium 3-[omega-fluoro alkanoyl (C6 to C8)N-ethylamino]-1-propanesulfanate, fluoroalkyl (C11 to C20) carboxylic acids and metallic salts thereof, perfluoro alkyl carboxylic acids (C7 to C13) and metallic salts thereof, perfluoro alkyl (C4 to C12) sulfonate and metallic salts thereof, perfluorooctane diethanolamide sulfonate, N-propyl-N-(2 hydroxyethyl) perfluorooctane sulfonamide, perfluoro alkyl (C6 to C10) sulfonamide propyl trimethyl ammonium salts, perfluoro alkyl (C6 to C10)-N-ethyl sulfonyl glycin salts, monoperfluoro alkyl (C6 to C16) ethyl ester phosphate, and the like.

Example products of the anionic surfactant include Surflon S-111, S-112, and S-113 available from Asahi Glass Co., Ltd., Fluorad FC-93, FC-95, FC-98, and FC-129 available from Sumitomo 3M Limited, Unidyne DS-101 and DS-102 available from Daikin Industries, Ltd., Megaface F-110, F-120, F-113, F-191, F-812, and F-833 available from Dainippon Ink and Chemicals, Incorporated, EFTOP EF-102, EF-103, EF-104, EF-105, EF-112, EF-123A, EF-123B, EF-306A, EF-501, EF-201, and EF-204 available from JEMCO Inc., FTERGENT F-100 and F-150 available from NEOS Company Limited, and the like.

Examples of the cationic surfactant include primary, secondary, and tertiary aliphatic amic acids, aliphatic, quaternary ammonium salts (e.g., perfluoroalkyl (C6 to C10) sulfonamide propyl trimethyl ammonium salt and the like), benzalkonium salts, benzethonium chloride, pyridinium salts, imidazolinium salts, and the like. All of the above have a fluoroalkyl group. Example products of the cationic surfactant include Surflon S-121 available from Asahi Glass Co., Ltd., Fluorad FC-135 available from Sumitomo 3M Limited, Unidyne DS-202 available from Daikin Industries, Ltd., Megaface F-150 and F-824 available from Dainippon Ink and Chemicals, Incorporated, EFTOP EF-132 available from JEMCO Inc., FTERGENT F-300 available from NEOS Company Limited, and the like.

Various known inorganic compounds, which are insoluble or hardly soluble in water, can be used as the inorganic fine particles in the aqueous medium. Examples of the inorganic compounds include tricalcium phosphate, calcium carbonate, titanium oxide, colloidal silica, hydroxy apatite, and the like.

Various known fine particles, which are insoluble or hardly soluble in water, can be used as the polymer fine particles in the aqueous medium. Examples of the fine particles include hydrophobic high polymer fine particles (e.g., hydrocarbon resins, fluorocarbon resins, silicone resins, and the like).

The above fine particles usually have a particle size smaller than a particle size of toner particles. A particle size ratio of volume average particle size of the fine particles to volume average particle size of the toner particles is preferably in a range of from about 0.001 to about 0.3 to keep uniform particle size. When the particle size ratio is more than about 0.3, the fine particles may not be effectively attracted onto surfaces of the toner particles. Thus, a particle size distribution of the toner particles tends to become broad.

The volume average particle size of the fine particles can be properly adjusted within the above range of the particle size ratio so that toner particles of a desired particle size can be obtained. For example, the volume average particle size of the fine particles is preferably adjusted in a range of from about 0.0025 μm to about 1.5 μm and is more preferably adjusted in a range of from about 0.005 μm to about 1.0 μm to obtain toner particles having a volume average particle size of about 5.0 μm. The volume average particle size of the fine particles is preferably adjusted in a range of from about 0.005 μm to about 3.0 μm and is more preferably adjusted in a range of from about 0.05 μm to about 2.0 μm to obtain toner particles having a volume average particle size of about 10.0 μm.

Various hydrophilic high polymer substances, which form high polymer protective colloids in the aqueous medium, can be added as a dispersion stabilizer in the aqueous medium. Examples of monomers constituting the high polymer substances include acids (e.g., acrylic acid, methacrylic acid, and the like), nitrogen compounds (e.g., vinyl imidazole, ethyleneimine, and the like), vinyl monomers (e.g., heterocyclic nitrogen compounds), and the like.

Examples of the high polymer substances, which can be preferably used according to this example embodiment, include polyoxyethylene compounds (e.g., polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, polyoxyethylene nonylphenylester, and the like), cellulose compounds (e.g., methyl cellulose, hydroxyethyl cellulose, hydroxypropyl cellulose, and the like), and the like.

To remove the liquid medium from the emulsified dispersion liquid obtained after the polyaddition reaction between the polyester prepolymer A and the amine B, a liquid medium removing process can include a process of gradually increasing a temperature of the emulsified dispersion liquid to remove the organic solvent by evaporating it. A circularity of toner particles can be controlled by a strength of stirring the emulsified dispersion liquid before removing the organic solvent and a period of time required for removing the organic solvent. When the organic solvent is slowly removed, a sphericity of the toner particles may increase and the circularity of the toner particles may be not less than about 0.980. When the emulsified dispersion liquid is strongly stirred and the organic solvent is removed in a short period of time, the toner particles may be formed in a convexo-concave shape or may not have a uniform shape and the circularity of the toner particles may be in a range of from about 0.900 to about 0.950. When the organic solvent is removed while the emulsified dispersion liquid obtained after the dispersion and reaction processes is strongly stirred at a temperature in a range of from about 30 degrees centigrade to about 50 degrees centigrade in a stirring vessel, the circularity of the toner particles can be controlled within a range of from about 0.850 to about 0.990. This may result from contraction in volume caused by rapid removal of the organic solvent such as ethyl acetate added while the toner particles are formed.

Alternatively, the emulsified dispersion liquid may be sprayed in a dry atmosphere to completely remove the organic solvent so that toner particles are formed and to remove the aqueous dispersing agent by evaporating it. Examples of the dry atmosphere include gases in which air, nitrogen, carbon dioxide, combustion gas, and the like are heated, and preferably include airflows heated to a temperature equaling or exceeding a boiling point of the liquid medium having a boiling point higher than that of any other constituent. Processing requiring a short period of time by using a spray dryer, a belt dryer, or a rotary kiln can produce high quality toner particles.

A period of time required after the reaction until the removal of the organic solvent is preferably as short as possible and is usually within about 25 hours.

When a substance soluble in an acid or alkaline medium, such as calcium phosphate salt, is used as the inorganic fine particles, the inorganic fine particles can be removed from the toner particles by dissolving the inorganic fine particles in an acid such as hydrochloric acid and rinsing them. Alternatively, the inorganic fine particles may be removed by a zymolytic method.

When the dispersing agent is used, the dispersing agent can remain on a surface of the toner particle. However, it is preferable to remove the dispersing agent by washing after the reaction between the polyester prepolymer A and the amine B to improve chargeability of the toner particle.

A solvent in which the polyester prepolymer A and the urea-modified polyester UMPE are soluble can be added to the aqueous medium to decrease a viscosity of the dispersion liquid after the reaction. The solvent is preferably used to obtain a sharp particle size distribution. The solvent can be easily removed if the solvent is volatile and has a boiling point lower than about 100 degrees centigrade. Examples of the solvent include a single substance (e.g., toluene, xylene, benzene, carbon tetrachloride, methylene chloride, 1,2-dichloroethane, and the like) or a mixture of two or more of the above substances. Examples of the solvent preferably include aromatic solvents (e.g., toluene, xylene, and the like), halogenated hydrocarbons (e.g., methylene chloride, 1,2-dichlorane, chloroform, carbon tetrachloride, and the like), and the like. An amount of the solvent against 100 parts by weight of the polyester prepolymer A is usually in a range of from about 0 part by weight to about 300 parts by weight, preferably in a range of from about 0 part by weight to about 100 parts by weight, and more preferably in a range of from about 25 parts by weight to about 75 parts by weight. When the solvent is used, the solvent is removed by heating the solvent under a normal or reduced pressure after the reaction between the polyester prepolymer A and the amine B.

A period of time of the reaction between the polyester prepolymer A and the amine B is selected based on a reactivity of a combination of a structure of the isocyanate group of the polyester prepolymer A with the amine B, but usually in a range of from about 10 minutes to about 40 hours and preferably in a range of from about 2 hours to about 24 hours. A temperature of the reaction is usually in a range of from about 0 degrees centigrade to about 150 degrees centigrade and preferably in a range of from about 40 degrees centigrade to about 98 degrees centigrade. Known catalysts can be used, as needed. Examples of the catalysts include dibutyltin laurate, dioctyltin laurate, and the like.

To wash and dry by maintaining a broad particle size distribution of the toner particles in the emulsified dispersion liquid after the reaction between the polyester prepolymer A and the amine B, the toner particles can be sized according to a desired particle size distribution. In this case, fine particles are removed in the liquid with a cyclone, a decanter, a centrifugal separator, or the like. The toner particles in a powder form may be sized after being dried. However, the toner particles can be effectively sized in the liquid. Removed fine or coarse toner particles are reused to produce toner particles in a mixing-kneading process. In this case, the fine or coarse toner particles may be wet.

It is preferable to remove the dispersing agent from the dispersion liquid as much as possible while the toner particles are sized.

When the dried toner particles are mixed with different types of particles such as releasing agent fine particles, charging control agent fine particles, and fluidizing agent fine particles, as needed, a mechanical impact is applied to the mixed particles to stabilize and integrate the different types of particles on the surfaces of the toner particles. Thus, it is possible to prevent the different types of particles from separating from surfaces of complex particles obtained.

Specifically, example methods for applying the mechanical impact to the mixed particles include a method in which a wheel rotating at a high speed applies an impact to the mixed particles and a method in which the mixed particles are thrown into a high-speed airflow and accelerated so that a particle hits another particle or the complex particles hit an appropriate plate. Example devices for applying the mechanical impact to the mixed particles include a device obtained by modifying an ong mill available from Hosokawa Micron Corporation or an I-type mill available from Nippon Pneumatic Mfg. Co. to generate a reduced pulverizing air pressure, a hybridization system available from Nara Machinery, Co., Ltd., a Kryptron system available from Kawasaki Heavy Industries, Ltd., an automatic mortar, and the like.

To use the toner according to this example embodiment as a two-component developer, magnetic carriers can be mixed with the toner. A content ratio between the magnetic carriers and the toner contained in the two-component developer is preferably about 100 parts by weight of the magnetic carriers against about 1 to 10 parts by weight of the toner. The magnetic carriers include known carriers having a particle size in a range of from about 20 μm to about 200 μm, such as iron powders, ferrite powders, magnetite powders, and magnetic resin carriers. Examples of a coating material for covering the magnetic carrier include silicone resins, fluorine-containing resins, and the like. The coating resin may contain conductive powders and the like, as needed. Examples of the conductive powders include metal powders, carbon black, titanium oxide, tin oxide, zinc oxide, and the like. The conductive powders preferably have an average particle size not larger than about 1 μm. When the average particle size is larger than about 1 μm, it may be difficult to control electrical resistance.

Alternatively, the toner according to this example embodiment can be used as a one-component magnetic toner or a one-component non-magnetic toner without the carriers.

The following describes examples of the toner according to this example embodiment. Table 1 below shows properties of the example toners.

An Additive Polyester for a First Example was Prepared as Below.

An adduct of bisphenol A with 2 moles of ethylene oxide in an amount of 690 parts by weight and terephthalic acid in an amount of 230 parts by weight were polycondensated for about 10 hours at about 210 degrees centigrade under a normal pressure in a reaction vessel including a condenser, a stirrer, and a nitrogen inlet. The polycondensated materials were reacted for about 5 hours under a pressure reduced in a range of from about 10 mmHg to about 15 mmHg, and then cooled down to about 160 degrees centigrade. Phthalic anhydride in an amount of 18 parts by weight was added to the cooled materials and reacted for about 2 hours to produce an unmodified polyester A1 having a weight average molecular weight Mw of 85,000.

A Prepolymer for the First Example was Prepared as Below.

The adduct of bisphenol A with 2 moles of ethylene oxide in an amount of 800 parts by weight, isophthalic acid in an amount of 160 parts by weight, terephthalic acid in an amount of 60 parts by weight, and dibutyltin oxide in an amount of 2 parts by weight were put into a reaction vessel including a condenser, a stirrer, and a nitrogen inlet, and reacted for about 8 hours at about 230 degrees centigrade under a normal pressure. The reacted materials were further reacted for about 5 hours under a pressure reduced in a range of from about 10 mmHg to about 15 mmHg while being dehydrated, and then cooled down to about 160 degrees centigrade. Phthalic anhydride in an amount of 32 parts by weight was added to the cooled materials and reacted for about 2 hours. The reacted materials were cooled down to about 80 degrees centigrade and reacted with isophorone diisocyanate in an amount of 170 parts by weight in ethyl acetate for about 2 hours to produce a prepolymer B1 having the isocyanate group having a weight average molecular weight Mw of 35,000.

A Ketimine Compound for the First Example was Prepared as Below.

Isophorone diamine in an amount of 30 parts by weight and methyl ethyl ketone in an amount of 70 parts by weight were put into a reaction vessel including a stirring bar and a thermometer and reacted for about 5 hours at about 50 degrees centigrade to produce a ketimine compound C1.

A Toner for the First Example was Prepared as Below.

The prepolymer B1 in an amount of 14.3 parts by weight, the polyester A1 in an amount of 55 parts by weight, and ethyl acetate in an amount of 78.6 parts by weight were put into a beaker, and stirred and dissolved. Rice wax, serving as a releasing agent, in an amount of 10 parts by weight having a melting point of about 83 degrees centigrade, and a copper phthalocyanine blue pigment in an amount of 4 parts by weight were added and stirred for about 5 minutes at about 40 degrees centigrade at a speed of about 12,000 rpm with a T.K. homo mixer. The stirred materials were pulverized for about 30 minutes at about 20 degrees centigrade with a bead mill to produce a toner material oily dispersion liquid D1.

Ion-exchanged water in an amount of 306 parts by weight, a suspension liquid containing 10 percent of tricalcium phosphate in an amount of 265 parts by weight, and sodium dodecylbenzenesulfonate in an amount of 0.2 parts by weight were put into a beaker to produce a water dispersed liquid E1. While the water dispersed liquid E1 was stirred at the speed of about 12,000 rpm with the T.K. homo mixer, the toner material oily dispersion liquid D1 and the ketimine compound C1 in an amount of 2.7 parts by weight were added to cause urea reaction.

An organic solvent was removed from the reacted liquid having a viscosity of about 3,500 mP·s within about an hour at about 50 degrees centigrade or lower under a reduced pressure. Then, the reacted liquid was filtered, washed, dried, and wind-sized to produce mother toner particles F1 in a spherical shape.

The mother toner particles F1 in an amount of 100 parts by weight and a charging control agent (e.g., BONTRON E-84 available from Orient Chemical Industries, Ltd.) in an amount of 0.25 parts by weight were put into a Q-type mixer available from Mitsui Mining Co., Ltd. and mixed at a peripheral speed of about 50 m/sec of a turbine wheel. The turbine wheel was rotated for 2 minutes and stopped for 1 minute as a cycle. The cycle was repeated for 5 times so that the materials put in the Q-type mixer were mixed for 10 minutes in total.

Hydrophobic silica (e.g., H2000 available from Clariant (Japan) K.K.) in an amount of 0.5 parts by weight was added and mixed at a peripheral speed of about 15 m/sec of the turbine wheel to produce a cyan toner G1. The turbine wheel was rotated for 30 seconds and stopped for 1 minute as a cycle. The cycle was repeated for 5 times. An average dispersed particle size of the pigment colorant was 0.40 μm. A number ratio of particles having a particle size not smaller than 0.7 μm was 3.5 percent.

TABLE 1

| | Properties of toner binder | | |
|---|---|---|---|
| Example | Peak molecular weight | Acid number (mgKOH/g) | Glass transition point (° C.) |
| 1 | 4,000 | 10 | 55 |
| 2 | 5,200 | 8 | 60 |
| 3 | 4,500 | 15 | 62 |
| 4 | 8,000 | 7 | 57 |
| 5 | 7,000 | 7 | 58 |

Magenta Master Batch Particles for a Second Example were Prepared as Below.

Water in an amount of 600 parts by weight and a Pigment Red 57 hydrated cake containing a 50 percent solid content in an amount of 200 parts by weight were sufficiently stirred with a flusher. A polyester resin in an amount of 1,200 parts by weight having an acid number of 3 mgKOH/g, a hydroxyl number of 25 mgKOH/g, a number average molecular weight Mn of 3,500, a ratio Mw/Mn of a weight average molecular weight Mw to a number average molecular weight Mn of 4.0, and a glass transition point of 60 degrees centigrade was added, mixed, and kneaded for about 30 minutes at about 150 degrees centigrade. Xylene in an amount of 1,000 parts by weight was added, mixed, and kneaded for about an hour. After the water and the xylene were removed, the mixed materials were flat-rolled, cooled, pulverized with a pulverizer, and passed twice through a three-roll mill to produce magenta master batch particles MB-1M having an average particle size of 0.2 μm.

A Prepolymer for the Second Example was Prepared as Below.

The adduct of bisphenol A with 2 moles of ethylene oxide in an amount of 856 parts by weight, isophthalic acid in an amount of 200 parts by weight, terephthalic acid in an amount of 20 parts by weight, and dibutyltin oxide in an amount of 4 parts by weight were put into a reaction vessel including a condenser, a stirrer, and a nitrogen inlet, and reacted for about 6 hours at about 250 degrees centigrade under a normal pressure. The reacted materials were further reacted for about 5 hours under a pressure reduced in a range of from about 50 mmHg to about 100 mmHg while being dehydrated, and then cooled down to about 160 degrees centigrade. Phthalic anhydride in an amount of 18 parts by weight was added to the cooled materials and reacted for about 2 hours. The reacted materials were cooled down to about 80 degrees centigrade and reacted with isophorone diisocyanate in an amount of 170 parts by weight in ethyl acetate for about 2 hours to produce a prepolymer B2 having the isocyanate group having a weight average molecular weight Mw of 25,000.

A Toner for the Second Example was Prepared as Below.

The prepolymer B2 in an amount of 15.4 parts by weight, the polyester A1 in an amount of 50 parts by weight, and ethyl acetate in an amount of 95.2 parts by weight were put into a beaker, and stirred and dissolved. Camauba wax in an amount of 10 parts by weight having a molecular weight of 1,800, an acid number of 2.5 mgKOH/g, and a needle penetration degree of about 1.5 mm at about 40 degrees centigrade, and the magenta master batch particles MB-1M in an amount of 10 parts by weight were added and stirred at about 85 degrees centigrade at a speed of about 10,000 rpm with a T.K. homo mixer. The stirred materials were wet-pulverized with a bead mill in a manner similar to that described above in the first example to produce a toner material oily dispersion liquid D2.

Mother toner particles F2 in a spherical shape were produced in a manner similar to that described above in the first example except for using a water dispersed liquid E2 obtained in a manner similar to that described above in the first example.

A toner G2 was produced in a manner similar to that described above in the first example except for using BONTRON E-89 available from Orient Chemical Industries Ltd. instead of BONTRON E-84 as a charging control agent. An average dispersed particle size of the pigment colorant contained in the toner G2 was 0.25 μm. A number ratio of particles having a particle size not smaller than 0.5 μm was 1.0 percent.

A Prepolymer for a Third Example was Prepared as Below.

The adduct of bisphenol A with 2 moles of ethylene oxide in an amount of 755 parts by weight, isophthalic acid in an amount of 195 parts by weight, terephthalic acid in an amount of 15 parts by weight, and dibutyltin oxide in an amount of 4 parts by weight were put into a reaction vessel including a condenser, a stirrer, and a nitrogen inlet, and reacted for about 8 hours at about 220 degrees centigrade under a normal pressure. The reacted materials were further reacted for about 5 hours under a pressure reduced in a range of from about 50 mmHg to about 100 mmHg while being dehydrated, and then cooled down to about 160 degrees centigrade. Phthalic anhydride in an amount of 10 parts by weight was added to the cooled materials and reacted for about 2 hours. The reacted materials were cooled down to about 80 degrees centigrade and reacted with isophorone diisocyanate in an amount of 170 parts by weight in ethyl acetate for about 2 hours to produce a prepolymer B3 having the isocyanate group having a weight average molecular weight Mw of 25,000.

A Toner for the Third Example was Prepared as Below.

The prepolymer B3 in an amount of 15.4 parts by weight, the polyester Al in an amount of 50 parts by weight, and ethyl acetate in an amount of 95.2 parts by weight were put into a beaker, and stirred and dissolved. Camauba wax in an amount of 10 parts by weight having the molecular weight of 1,800, the acid number of 2.5 mgKOH/g, and the needle penetration degree of about 1.5 mm at about 40 degrees centigrade, and the master batch particles MB-1M in an amount of 15 parts by weight were added and stirred at about 85 degrees centigrade at a speed of about 14,000 rpm with a T.K. homo mixer so as to be uniformly dispersed. The stirred materials were wet-pulverized for about 60 minutes at about 15 degrees centigrade with a bead mill to produce a toner material oily dispersion liquid D3.

Ion-exchanged water in an amount of 465 parts by weight, a suspension liquid containing 10 percent of sodium carbonate in an amount of 245 parts by weight, and sodium dodecylbenzenesulfonate in an amount of 0.4 parts by weight were put into a beaker and stirred to produce a water dispersed liquid E3. A temperature of the water dispersed liquid E3 was increased to about 40 degrees centigrade. While the water dispersed liquid E3 was stirred at the speed of about 12,000 rpm with the T.K. homo mixer, the toner material oily dispersion liquid D3 was added and stirred for about 10 minutes. Then, a ketimine compound C3 in an amount of 2.7 parts by weight was added and reacted. An organic solvent was removed from the reacted liquid within about an hour at about 40 degrees centigrade. Then, the reacted liquid was filtered, washed, and dried in a manner similiar to that described above in the second example to produce mother toner particles F3 in a spherical shape.

A toner G3 was produced in a manner similar to that described above in the first example except for using the mother toner particles F3. An average dispersed particle size of the pigment colorant contained in the toner G3 was 0.15 μm. A number ratio of particles having the particle size not smaller than 0.5 μm was 3.0 percent.

A Toner Binder for a Fourth Example was Prepared as Below.

The adduct of bisphenol A with 2 moles of ethylene oxide in an amount of 354 parts by weight, isophthalic acid in an amount of 166 parts by weight, and dibutyltin oxide in an amount of 2 parts by weight as a catalyst were poly-condensed to produce a comparative toner binder H11 having a glass transition point of 57 degrees centigrade.

A Toner for the Fourth Example was Prepared as Below.

The comparative toner binder H11 in an amount of 100 parts by weight, an ethyl acetate solution in an amount of 200 parts by weight, the copper phthalocyanine blue pigment in an amount of 4 parts by weight, and the rice wax used in the first example in an amount of 5 parts by weight were put into a beaker and stirred at about 50 degrees centigrade at the speed of about 12,000 rpm with a T.K. homo mixer to produce a comparative dispersed liquid I11. A comparative toner J11 having a volume average particle size of 6 μm was produced in a manner similar to that described above in the first example except for using the comparative dispersed liquid I11. An average dispersed particle size of the pigment colorant contained in the comparative toner J11 was 0.70 μm. A number ratio of particles having a particle size not smaller than 0.7 μm was 35.0 percent.

A Toner Binder for a Fifth Example was Prepared as Below.

The adduct of bisphenol A with 2 moles of ethylene oxide in an amount of 343 parts by weight, isophthalic acid in an amount of 166 parts by weight, and dibutyltin oxide in an amount of 2 parts by weight were put into a reaction vessel including a condenser, a stirrer, and a nitrogen inlet, and reacted for about 8 hours at about 230 degrees centigrade under a normal pressure. The reacted materials were further reacted for about 5 hours under a pressure reduced in a range of from about 10 mmHg to about 15 mmHg, and then cooled down to about 80 degrees centigrade. Toluene diisocyanate in an amount of 14 parts by weight was added to toluene and reacted for about 5 hours at about 110 degrees centigrade. An inorganic solvent was removed to produce a urethane-modified polyester having a peak molecular weight of 7,000. The adduct of bisphenol A with 2 moles of ethylene oxide in an amount of 363 parts by weight and isophthalic acid in an amount of 166 parts by weight were poly-condensed in a manner similar to that described above in the first example to produce an unmodified polyester having a peak molecular weight of 3,800 and an acid number of 7 mgKOH/g. The urethane-modified polyester in an amount of 350 parts by weight and the unmodified polyester in an amount of 650 parts by weight were dissolved and mixed in the toluene. An inorganic solvent was removed to produce mother toner particles of a comparative toner binder H12 having a glass transition point of 58 degrees centigrade.

A Toner for the Fifth Example was Prepared as Below.

The comparative toner binder H12 in an amount of 100 parts by weight, the master batch particles used in the second example in an amount of 10 parts by weight, and the camauba wax in an amount of 10 parts by weight were added to produce a toner as described below. The added materials were premixed with a Henschel mixer, and then mixed and kneaded with a continuous mixer/kneader. The kneaded mixture was pulverized with a jet pulverizer and sized with an air current type sizing device to produce toner particles having a volume average particle size of 6 μm. The toner particles in an amount of 100 parts by weight, hydrophobic silica in an amount of 0.5 parts by weight, and hydrophobic titanium oxide in an amount of 0.5 parts by weight were mixed with the Henschel mixer to produce a comparative toner J12. An average dispersed particle size of the pigment colorant contained in the comparative toner J12 was 0.70 μm. A number ratio of particles having a particle size not smaller than 0.5 μm was 15.0 percent.

Table 2 shows evaluations of the above toners for the first, second, third, fourth, and fifth examples.

TABLE 2

| Exa | Dv (μm) | Dn (μm) | Dv/Dn | Cir | Flu (g/ml) | Low (° C.) | Hot (° C.) | Glo (° C.) | Haze | Pig (μm) | Num (%) |
|---|---|---|---|---|---|---|---|---|---|---|---|
| 1 | 5.6 | 4.8 | 1.15 | 0.940 | 0.30 | 150 | 220 | 160 | Medium | 0.40 | 36 |
| 2 | 6.8 | 6.2 | 1.10 | 0.950 | 0.35 | 150 | 220 | 150 | High | 0.25 | 1 |
| 3 | 4.9 | 4.2 | 1.17 | 0.930 | 0.44 | 160 | 230 | 160 | High | 0.15 | 2 |
| 4 | 6.0 | 4.6 | 1.30 | 0.970 | 0.25 | 155 | 200 | 160 | Medium | 0.70 | 35 |
| 5 | 7.5 | 6.1 | 1.22 | 0.925 | 0.23 | 160 | 180 | 150 | Medium | 0.70 | 15 |

In Table 2, "Exa" denotes example number, "Dv" denotes weight average particle size, "Dn" denotes number average particle size, "Dv/Dn" denotes ratio of weight average particle size to number average particle size, "Cir" denotes circularity, "Flu" denotes fluidity, "Low" denotes lower-limit fixing temperature, "Hof" denotes hot offset temperature, "Glo" denotes gloss temperature, "Haze" denotes level of haze, "Pig" denotes pigment particle size, and "Num" denotes number ratio of pigment particle size not smaller than 0.7 μm.

Glass Transition Point was Measured as Below.

Glass transition point was measured with TG-DSC system TAS-100 available from Rigaku Corporation.

A test sample of about 10 mg was put into an aluminum sample container. The aluminum sample container was placed on a holder unit and set in an electric furnace. The test sample was heated up to about 150 degrees centigrade from a room temperature at a speed of about 10 degrees centigrade per minute, and was kept at about 150 degrees centigrade for about 10 minutes. The test sample was cooled down to the room temperature, and was kept at the room temperature for about 10 minutes. The test sample was heated again up to about 150 degrees centigrade at a speed of about 10 degrees centigrade per minute under a nitrogen atmosphere to perform a DSC (differential scanning calorimetry) measurement. A glass transition point was calculated based on a contact point of a tangent line of an endothermic curve near the glass transition point and a base line by using an analysis system of the system TAS-100.

Acid Number was Measured as Below.

Acid number was measured in accordance with JISK 0070. When the test sample was not dissolved, dioxane, terahydrofuran, or the like was used as a solvent.

Fluidity was Measured as Below.

A bulk density in a unit of g/ml was measured with a powder tester available from Hosokawa Micron Corporation. The better fluidity a toner has, the higher bulk density the toner has. The bulk density of lower than 0.25 g/ml was evaluated as being very poor. The bulk density in a range of from 0.25 g/ml to lower than 0.30 g/ml was evaluated as being poor. The bulk density in a range of from 0.30 g/ml to lower than 0.35 g/ml was evaluated as being good. The bulk density in a range of 0.35 g/mil or higher was evaluated as being very good.

A Lower-Limit Fixing Temperature was Measured as Below.

Test copying was performed on sheets TYPE 6200 available from Ricoh Co., Ltd. with a copying machine MF-200 available from Ricoh Co., Ltd. including a Teflon® roller as a fixing roller of a modified fixing device. A temperature of the fixing roller, at which a 70 percent or higher image density remained after a fixed image was scrubbed with a pat, was measured as a lower-limit fixing temperature.

Hot Offset Temperature was Measured as Below.

Fixing was evaluated as described above for measuring the lower-limit fixing temperature. Whether a hot offset occurred on a fixed image or not was visually checked. A temperature of the fixing roller, at which the hot offset occurred, was measured as a hot offset temperature.

Gloss Temperature was Measured as Below.

Fixing was evaluated with a fixing device of a color copying machine PRETER 550 available from Ricoh Co., Ltd. A temperature of the fixing roller, at which a 60-degree angle gloss on a fixed image was not less than about 10 percent, was measured as a gloss temperature.

Haze was Measured as Below.

Haze was measured with a direct-reading haze computer HGM-2DP.

The high quality toner according to this example embodiment produces a high-quality, high-resolution image and has an advantage in both fixability at a low temperature and hot offset resistance. The image forming apparatus 1 (depicted in FIG. 1) using the toner according to this example embodiment can produce an image having improved transparency and saturation and a controlled gloss. The toner according to this example embodiment also has an advantage in charging stability and color reproduction.

By using the toner according to this example embodiment, the image forming apparatus 1 can form a high quality image providing improved color production, saturation, transparency, and gloss. Further, the toner can provide stable development property for a long period of time.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device, comprising:

a first fixing member having a roller shape;

a second fixing member having an endless belt shape and disposed opposite the first fixing member, the first fixing member and the second fixing member forming a pair of fixing members to nip a recording medium so as to fix a toner image on the recording medium by applying heat and pressure to the recording medium;

a plurality of rollers around which the second fixing member is stretched;

a pressure application lever to press the second fixing member toward the first fixing member, including an immovable end fixed to a fixing device support and a movable end provided opposite the immovable end;

a pressure release lever rotatably supported by the pressure application lever, a lock member rotatably supported by the pressure release lever at a first end, with a second end provided opposite the first end;

a first shaft to rotatably support the pressure release lever and the lock member; and an elastic member to engage the second end of the lock member to pull the lock member in a lock direction, wherein the pressure release lever rotates to move the lock member between a pressure application position, at which the lock member causes the pressure application lever to press the second fixing member toward the first fixing member so as to apply tension to the second fixing member, and a pressure release position, at which the pressure application lever moves toward the second fixing member to separate the second fixing member from the first fixing member and release tension applied to the second fixing member, the elastic member pulls the pressure application lever and the lock member in the lock direction when the lock member is positioned at the pressure application position, and when the pressure release lever moves about the first shaft in a counterclockwise direction, the pressure release lever moves toward an upper side of the lock member.

2. The fixing device according to claim 1, further comprising:

a second shaft to rotatably support the pressure release lever and the pressure application lever, wherein the first shaft rotates about the second shaft and moves on a line connecting the second shaft with the second end of the lock member, when the lock member moves from the pressure release position to the pressure application position.

3. The fixing device according to claim 2, further comprising:

a protrusion provided on the lock member, wherein the lock member engages the second shaft at the pressure application position and does not engage the second shaft at the pressure release position, and wherein the second shaft surmounts the protrusion when the lock member moves from the pressure release position to the pressure application position.

4. The fixing device according to claim 2, further comprising:

a protrusion provided on the lock member; and a bearing to support the second shaft, wherein the lock member engages the bearing at the pressure application position and does not engage the bearing at the pressure release position, and wherein the bearing surmounts the protrusion when the lock member moves from the pressure release position to the pressure application position.

5. The fixing device according to claim 1, wherein one end of the pressure release lever engages a cover in such a manner that the pressure release lever rotates with opening and closing of the cover.

6. The fixing device according to claim 5, further comprising:

a roller provided on the one end of the pressure release lever to slide on the cover.

7. The fixing device according to claim 1, wherein pressure with which the first fixing member and the second fixing member nip the recording medium is adjustable.

8. An image forming apparatus, comprising:

an image forming device to form a toner image using a developer including toner on a recording medium according to image data; and a fixing device to fix the toner image on the recording medium, the fixing device including:

a first fixing member having a roller shape;

a second fixing member having an endless belt shape and disposed opposite the first fixing member, the first fixing member and the second fixing member forming a pair of fixing members to nip the recording medium so as to fix the toner image on the recording medium by applying heat and pressure to the recording medium;

a plurality of rollers around which the second fixing member is stretched;

a pressure application lever to press the second fixing member toward the first fixing member, including an immovable end fixed to a fixing device support and a movable end provided opposite the immovable end;

a pressure release lever rotatably supported by the pressure application lever, a lock member rotatably supported by the pressure release lever at a first end, with a second end provided opposite the first end;

a first shaft to rotatably support the pressure release lever and the lock member; and an elastic member to engage the second end of the lock member to pull the lock member in a lock direction, wherein the pressure release lever rotates to move the lock member between a pressure application position, at which the lock member causes the pressure application lever to press the second fixing member toward the first fixing member so as to apply tension to the second fixing member, and a pressure release position, at which the pressure application lever moves toward the second fixing member so as to separate the second fixing member from the first fixing member and release tension applied to the second fixing member, the elastic member pulls the pressure application lever and the lock member in the lock direction when the lock member is at the pressure application position, and when the pressure release lever moves about the first shaft in a counterclockwise direction, the pressure release lever moves toward an upper side of the lock member.

9. The fixing device according to claim 1, wherein at the pressure release position, the lock member moves closer to the elastic member so that the elastic member has a natural length.

10. The image forming apparatus according to claim 8, wherein at the pressure release position, the lock member moves closer to the elastic member so that the elastic member has a natural length.

* * * * *